US009344823B2

(12) United States Patent
Burnett

(10) Patent No.: US 9,344,823 B2
(45) Date of Patent: May 17, 2016

(54) PIPE CALIBRATION DEVICE FOR CALIBRATION OF OMNIDIRECTIONAL MICROPHONES

(75) Inventor: Gregory C. Burnett, Dodge Center, MN (US)

(73) Assignee: AliphCom, San Francisco, CA (US)

( * ) Notice: Subject to any disclaimer, the term of this patent is extended or adjusted under 35 U.S.C. 154(b) by 265 days.

(21) Appl. No.: 13/069,244

(22) Filed: Mar. 22, 2011

(65) Prior Publication Data

US 2011/0243347 A1 Oct. 6, 2011

Related U.S. Application Data

(60) Provisional application No. 61/316,269, filed on Mar. 22, 2010.

(51) Int. Cl.
*H04R 3/00* (2006.01)
*H04R 29/00* (2006.01)

(52) U.S. Cl.
CPC ..... *H04R 29/004* (2013.01); *H04R 29/005* (2013.01); *H04R 29/006* (2013.01); *H04R 29/007* (2013.01); *H04R 29/00* (2013.01)

(58) Field of Classification Search
USPC ..... 381/312, 313, 94, 95, 92, 97, 98
See application file for complete search history.

(56) References Cited

U.S. PATENT DOCUMENTS 2,806,544 A 9/1957 Witchey
4,002,862 A 1/1977 Turlais
4,924,707 A 5/1990 Kleisch
4,948,552 A 8/1990 Mollof et al.
5,105,822 A * 4/1992 Stevens et al. ..... 600/559
5,125,260 A 6/1992 Hedeen
5,410,920 A 5/1995 Westwick
5,567,863 A 10/1996 Larson et al.
6,061,456 A 5/2000 Andrea et al.
6,134,968 A 10/2000 Kunze, Jr. et al.
6,139,507 A 10/2000 Jeng
(Continued)

FOREIGN PATENT DOCUMENTS

WO 2011119630 9/2011
WO 2012021832 2/2012

OTHER PUBLICATIONS

Copenheaver, Blaine R., International Search Report mailed Feb. 1, 2012 for International Patent Application No. PCT/US2011/047629.
(Continued)

*Primary Examiner* — Duc Nguyen
*Assistant Examiner* — Phan Le
(74) *Attorney, Agent, or Firm* — Kokka & Backus, PC

(57) ABSTRACT

Embodiments include a device comprising a pipe having at least one section that spans between a first end and a second end of the pipe. The pipe has a cylindrical cross-section. The device comprises a receptacle positioned in the pipe a first distance from the first end and a second distance from the second end. The receptacle receives an electronic device having microphones that are to be calibrated and secures the microphones a third distance inside an inside surface of the pipe. The device comprises an adapter connected to the first end. The adapter connects a loudspeaker to the pipe. The pipe controls an acoustic energy experienced by the plurality of microphones so that each microphone of the plurality of microphones receives equivalent acoustic energy.

75 Claims, 14 Drawing Sheets

(56) References Cited

U.S. PATENT DOCUMENTS

| | | | | |
|---|---|---|---|---|
| 6,148,672 | A * | 11/2000 | Cawley et al. | 73/622 |
| 6,705,319 | B1 * | 3/2004 | Wodicka et al. | 128/207.14 |
| 6,848,313 | B2 * | 2/2005 | Krieg et al. | 73/628 |
| 7,644,734 | B2 | 1/2010 | Palmer | |
| 2006/0005957 | A1 | 1/2006 | Moser et al. | |
| 2006/0147054 | A1 | 7/2006 | Buck et al. | |
| 2006/0262950 | A1 * | 11/2006 | Burns | 381/312 |
| 2008/0044002 | A1 | 2/2008 | Bevirt et al. | |
| 2008/0152186 | A1 | 6/2008 | Crowley | |
| 2009/0158850 | A1 * | 6/2009 | Alleyne et al. | 73/623 |
| 2009/0299742 | A1 | 12/2009 | Toman et al. | |
| 2010/0054487 | A1 | 3/2010 | Pan | |
| 2010/0158267 | A1 * | 6/2010 | Thormundsson et al. | 381/92 |
| 2011/0243341 | A1 | 10/2011 | Burnett | |
| 2011/0243348 | A1 | 10/2011 | Burnett | |
| 2012/0106749 | A1 | 5/2012 | Buck et al. | |

OTHER PUBLICATIONS

Copenheaver, Blaine R., Revised Version of International Search Report mailed Feb. 1, 2012 for International Patent Application No. PCT/US2011/047629.

Le, Phan, USPTO Office Action mailed Feb. 3, 2014 for U.S. Appl. No. 13/209,047.

Nguyen, Sean H., USPTO Office Action mailed Aug. 5, 2013 for U.S. Appl. No. 13/069,264.

Nguyen, Sean H., USPTO Office Action mailed May 7, 2014 for U.S. Appl. No. 13/069,264.

Nguyen, Sean H., USPTO Office Action mailed Nov. 4, 2014 for U.S. Appl. No. 13/069,264.

Le, Phan, USPTO Office Action mailed May 14, 2013 for U.S. Appl. No. 13/069,275.

Le, Phan, USPTO Office Action mailed Dec. 13, 2013 for U.S. Appl. No. 13/069,275.

Le, Phan, USPTO Office Action mailed Jun. 23, 2014 for U.S. Appl. No. 13/069,275.

Le, Phan, USPTO Office Action mailed Feb. 25, 2015 for U.S. Appl. No. 13/069,275.

Copenheaver, Blaine R., International Searching Authority, Written Opinion of the International Searching Authority and International Search Report, mailed Jun. 28, 2011 for International Patent Application No. PCT/US2011/029461.

* cited by examiner 1410 1420 1430

| | A (cm) | B (cm) | C (cm) | D (cm) | E (cm) | Total (cm) | Samp (cm) | Comments |
|---|---|---|---|---|---|---|---|---|
| 1 | 48.1 | 16.8 | 48.1 | 27.7 | 27.7 | 170.8 | 57.1 | Best overall, no disturbances and calibration good to Nyquist |
| 2 | 48.1 | 16.8 | 48.1 | 0.0 | 0.0 | 114.2 | 57.1 | Very good, tiny disturbances near 2 kHz |
| 3 | 48.1 | 16.8 | 27.7 | 0.0 | 0.0 | 93.8 | 57.1 | Good, small disturbances at 2 kHz and 600-700 Hz |
| 4 | 27.7 | 16.8 | 48.1 | 27.7 | 0.0 | 122.1 | 36.7 | Good, some degradation above 3.5 kHz |
| 5 | 27.7 | 16.8 | 48.1 | 0.0 | 0.0 | 93.8 | 36.7 | Good, some degradation above 3.5 kHz and disturbances near 2 kHz |
| 6 | 27.7 | 16.8 | 27.7 | 0.0 | 0.0 | 73.4 | 36.7 | Ok, degraded above 3.5 kHz and disturbances at 600-700 Hz and 2 kHz |
| 7 | 0.0 | 16.8 | 48.1 | 27.7 | 0.0 | 93.8 | 8.4 | Ok, degraded above 3 kHz, small disturbances near 2 kHz |
| 8 | 0.0 | 16.8 | 48.1 | 0.0 | 0.0 | 65.5 | 8.4 | Ok, degraded above 3 kHz, small disturbances near 2 kHz |
| 9 | 0.0 | 16.8 | 27.7 | 0.0 | 0.0 | 45.1 | 8.4 | Ok, degraded above 3 kHz, small disturbances near 650 Hz and 2 kHz |
| 10 | 15.2 | 16.8 | 27.7 | 0.0 | 0.0 | 59.7 | 24.2 | Ok, degraded above 3.3 kHz and disturbances at 600-700 Hz and 2 kHz |

1400

FIG. 14

PIPE CALIBRATION DEVICE FOR CALIBRATION OF OMNIDIRECTIONAL MICROPHONES

RELATED APPLICATION

This application claims the benefit of U.S. Patent Application No. 61/316,269, filed Mar. 22, 2010.

TECHNICAL FIELD

The disclosure herein relates generally to acoustic devices that employ omnidirectional microphones. In particular, this disclosure relates to calibration of omnidirectional microphone systems for use in noise suppressions systems, devices, and methods for use in acoustic applications.

BACKGROUND

Conventional adaptive noise suppression algorithms have been around for some time. These conventional algorithms have used two or more microphones to sample both an (unwanted) acoustic noise field and the (desired) speech of a user. The noise relationship between the microphones is then determined using an adaptive filter (such as Least-Mean-Squares as described in Haykin & Widrow, ISBN#0471215708, Wiley, 2002, but any adaptive or stationary system identification algorithm may be used) and that relationship is used to filter the noise from the desired signal.

Most conventional noise suppression systems currently in use for speech communication systems are based on a single-microphone spectral subtraction technique first develop in the 1970's and described, for example, by S. F. Boll in "Suppression of Acoustic Noise in Speech using Spectral Subtraction," IEEE Trans. on ASSP, pp. 113-120, 1979. These techniques have been refined over the years, but the basic principles of operation have remained the same. See, for example, U.S. Pat. No. 5,687,243 of McLaughlin, et al., and U.S. Pat. No. 4,811,404 of Vilmur, et al. There have also been several attempts at multi-microphone noise suppression systems, such as those outlined in U.S. Pat. No. 5,406,622 of Silverberg et al. and U.S. Pat. No. 5,463,694 of Bradley et al. Multi-microphone systems have not been very successful for a variety of reasons, the most compelling being poor noise cancellation performance and/or significant speech distortion. Primarily, conventional multi-microphone systems attempt to increase the SNR of the user's speech by "steering" the nulls of the system to the strongest noise sources. This approach is limited in the number of noise sources removed by the number of available nulls.

The Jawbone earpiece (referred to as the "Jawbone"), introduced by AliphCom of San Francisco, Calif., was the first known commercial product to use a pair of physical directional microphones (instead of omnidirectional microphones) to reduce environmental acoustic noise. The technology supporting the Jawbone is currently described under one or more of U.S. Pat. No. 7,246,058 by Burnett and/or U.S. patent application Ser. Nos. 10/400,282, 10/667,207, and/or 10/769,302. Generally, multi-microphone techniques make use of an acoustic-based Voice Activity Detector (VAD) to determine the background noise characteristics, where "voice" is generally understood to include human voiced speech, unvoiced speech, or a combination of voiced and unvoiced speech. The Jawbone improved on this by using a microphone-based sensor to construct a VAD signal using directly detected speech vibrations in the user's cheek. This allowed the Jawbone to aggressively remove noise when the user was not producing speech. The current Jawbone implementation also uses a pair of omnidirectional microphones to construct two virtual microphones that are used to remove noise from speech. The omnidirectional microphones are calibrated, that is, they both respond as similarly as possible when exposed to the same acoustic field. Calibration using standard techniques such as artificial mouths in acoustic boxes can be difficult, especially in noisy environments like a factory floor.

INCORPORATION BY REFERENCE

Each patent, patent application, and/or publication mentioned in this specification is herein incorporated by reference in its entirety to the same extent as if each individual patent, patent application, and/or publication was specifically and individually indicated to be incorporated by reference.

BRIEF DESCRIPTION OF THE DRAWINGS

FIG. 14 is a table of lengths of different sections for various combinations of straight pipes tested, the total length, and the microphone sampling point, under an embodiment.

DETAILED DESCRIPTION

Figure 1:
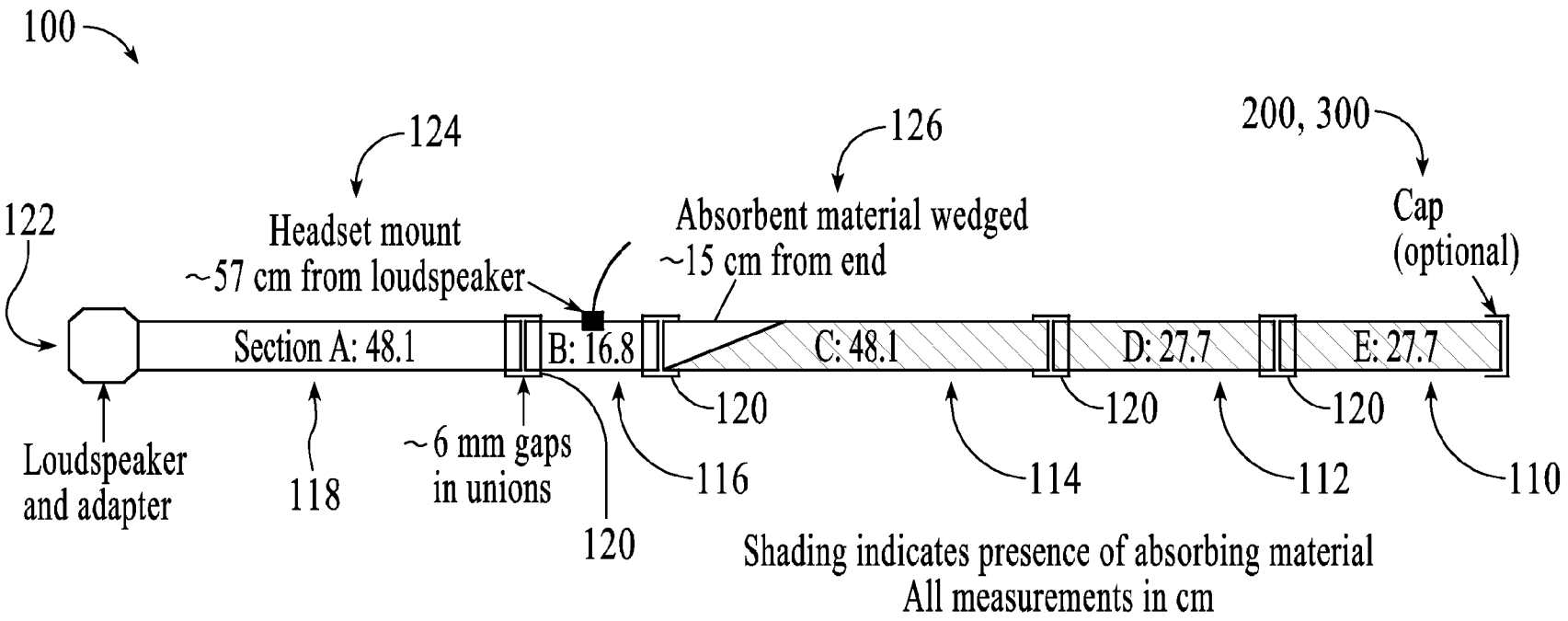
FIG. 1 shows an absorbent enablement with each section labeled with a letter and a length (see FIG. 14 for other configurations), under an embodiment.

A novel method through which microphones can be calibrated to a high degree of accuracy in a noise-robust way using cylindrical pipes is described in detail below. In order to properly form virtual microphones, omnidirectional microphones are calibrated before use so that they respond in the same way (both in magnitude and phase) to an identical acoustic input. Mounting issues can affect the response of a microphone, but in this description it is assumed that the microphones are properly mounted and respond to incoming acoustic waves as designed.

In order to properly calibrate the microphones, they are exposed to identical acoustic inputs at the frequencies of interest. "Identical", in this case, means that the acoustic inputs generally should have the same amplitude and phase for both microphones. Practically, this means variations of less than +−0.1 dB and +−5 degrees between the acoustic inputs. The frequencies of interest will depend on the application—for Bluetooth headsets calibration is normally required up to 4 kHz, but may be 8 kHz or higher for other applications.

Calibration can be accomplished in an anechoic or semi-anechoic chamber using carefully designed hardware configurations, but this is not practical for high-throughput assembly lines. In addition, the microphones should be calibrated in the headset or other final mounting configuration so that they are calibrated similar to the manner that they will be used. Also, if desired, geometric effects on the acoustic response of the microphones due to the mounting can be included in the calibration. Outside of a true anechoic chamber, it is very difficult to expose both microphones to input signals having the same magnitude and phase. Conventional calibration techniques use a carefully calibrated loudspeaker placed very close to the microphones inside an acoustic box that is not anechoic, but is small enough to be placed on an assembly line. Since reflections will be present inside the box, these conventional techniques rely on the loudspeaker's proximity to the microphones to overpower the reflected energy. This can be effective, but is very difficult to configure properly and may cease to work accurately if the microphones are positioned too far apart relative to each other (typically 20-25 mm is the largest distance practical). The resulting calibration filter normally has large (+−0.5 dB or more) ripples in its magnitude response due primarily to reflections inside the calibration box.

A far simpler and more effective calibration technique is to use cylindrical pipes to contain the output from the loudspeaker and funnel it to the microphones for calibration. Cylindrical pipes have resonant frequencies that depend on their length and the type of end cap they have, and this can be used to control the acoustic energy experienced by the microphones. Another embodiment uses acoustic energy absorbers to remove reflections inside the pipe, exposing the microphones to a traveling wave of the same amplitude and phase. The microphones can be placed so that they are just inside the surface of the pipe or inside the pipe itself.

The embodiments described herein are stable in operation, flexible with respect to microphone mount and location, and have proven to be robust with respect to exterior noise (no additional noise-proofing is required) and calibration algorithms.

In the following description, numerous specific details are introduced to provide a thorough understanding of, and enabling description for, embodiments of the calibration methods. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

Unless otherwise specified, the following terms have the corresponding meanings in addition to any meaning or understanding they may convey to one skilled in the art.

The term "omnidirectional microphone" means a physical microphone that is equally responsive to acoustic waves originating from any direction.

The term "O1" or "$O_1$" refers to the first omnidirectional microphone of an array, normally closer to the user than the second omnidirectional microphone. It may also, according to context, refer to the time-sampled output of the first omnidirectional microphone.

The term "O2" or "$O_2$" refers to the second omnidirectional microphone of an array, normally farther from the user than the first omnidirectional microphone. It may also, according to context, refer to the time-sampled output of the second omnidirectional microphone.

The term "noise" means unwanted environmental acoustic noise.

The term "virtual microphones (VM)" or "virtual directional microphones" means a microphone constructed using two or more omnidirectional microphones and associated signal processing.

The technique of an embodiment uses standard cylindrical pipe to form an acoustic cavity. This can be plastic PVC or ABS pipe, or cast iron, or other similar pipe. PVC and ABS pipe are recommended; they are inexpensive, easily cut and shaped, and have functioned well in tests. The pipes can be a single piece or several sections; for ease of construction and transport segmented sections using unions to connect them have been used with success. The pipes should be smooth and fit together tightly, although small gaps between sections have not proven to be a problem. The pipes can be glued together, but it is not necessary—slip fits are sufficient. A machined or otherwise fabricated adapter for the loudspeaker/pipe interface is recommended, but simply taping the loudspeaker to the pipe has resulted in adequate performance for many applications.

Since the amplitude of the wave in the pipe can vary with distance from the center of the pipe, the microphones should be mounted on or in the pipe so that they are the same distance from the center or wall of the pipe. If the resonant pipe is used, the microphones should be placed the same distance from the end of the pipe, since the amplitude and phase will vary with both frequency and distance from the end of the pipe. If the absorbent pipe is used, the microphones need not be the same distance from the end of the pipe, as the traveling wave amplitude should be relatively independent of the distance from the loudspeaker. The calibration routine, however, will have to be adjusted to take into account the time delay between the microphones due to the difference in distance to the loudspeaker. The microphones should be placed a sufficient distance from the loudspeaker to reduce near-field effects of the loudspeaker. In practice this was about 30 cm for the absorbent pipe and 20 cm for the resonant pipe, but this distance will depend on the loudspeaker and the frequencies of interest.

The microphones may be mounted near the inside surface of the pipe or inside the pipe itself. For applications where the highest accuracy is desired and the geometric effect of the microphone housing is not desired or important, it is recommended to mount the microphones so that they are just inside (e.g., approximately 2-5 mm for a 2.0 inch I.D. pipe) the inside surface of the pipe. This type of mount reduces the acoustic effect of the microphone housing on the inside environment of the pipe. For applications where the housing is small and/or the geometric effect of the housing on the response of the microphones is desired, the microphones and their mounting body (i.e., a headset) may be placed inside the pipe itself. This will affect the acoustic properties of the interior of the pipe, so comparison of the results calculated with an in-pipe mount to those calculated in an anechoic chamber is recommended.

For frequencies below 4 kHz, the recommended inside diameter (I.D.) of the pipe is 2.0 inches. This results in excellent stability and adequate amplitude and phase performance from near DC to about 3.8 kHz. A 3.0 inch I.D. pipe may be used, but this reduces the upper adequate performance frequency to about 2.5 kHz. A 4.0 inch I.D. pipe further reduces the upper adequate performance frequency to about 1.9 kHz. The upper adequate performance frequency can be estimated by using $$f_1 = \frac{1.125 * 343 \text{ m/s}}{2d} \text{Hz}$$

where the speed of sound has been estimated at 343 m/s and "d" is the inside diameter of the pipe in meters. Above this frequency the propagation of the acoustic waves are no longer parallel to the pipe; they begin to reflect from the sides of the pipe and propagate perpendicular to the length of the pipe. This disrupts the amplitude and phase for both kinds of pipes (absorbent and resonant) and results above these frequencies should be disregarded or, at least, confirmed using other means (e.g., using results from an anechoic chamber).

The loudspeaker is mounted to the pipe so that there is little or no leakage between the pipe and the loudspeaker. The other end of the pipe can be capped (closed) or open, depending on the desired response. Closed pipes are recommended for both resonant and absorbent pipes; for the former the resonances continue to much higher frequencies for closed pipes compared to open, and for the latter it results in a cleaner installation. For the absorbent enablement the end cap does not serve an acoustic function since enough absorbent material should be used so that the amount of energy reflecting from the cap or open end should be minimal. This means using enough absorbent material so that the amount of energy returning to the microphones is at least 40 dB less than the directly transmitted energy. More reflected energy can be tolerated, but can result in less robust performance and is not recommended.

The loudspeaker is excited using an electrical signal at a level that results in a good output level of the microphones under test. That is, the microphones should not be overdriven and a level of −12 dBFS is recommended. In addition, it is recommended that the exciting signal be equalized so that it is relatively white at the point it is being sampled by the microphones. With a resonant pipe this is not strictly possible, but the heights of the resonances can be approximately equalized. For an absorbent pipe the whitening equalization is usually relatively simple to do. This is not required but results in better performance and behavior from most calibration filter algorithms.

The output of the microphones is recorded and a conventional calibration processing technique is used to generate a calibration filter or filters, depending on the technique and the number of microphones. Any number of microphones may be calibrated using this embodiment, the only limit is how many of the microphones can be mounted properly on the pipe. The calibration filters generated by the calibration technique are then used to filter the output of each microphone so that the amplitude and phase of the microphones are equal for an identical input. This application does not include the signal processing calibration algorithm that generates the calibration filters using the outputs of the microphones when exposed to the acoustic energy inside the pipe. The novelty of this technique lies in the configuration of the loudspeaker, the pipes, and the microphones so that the acoustic energy each microphone is exposed to is as nearly identical in amplitude and phase as possible. Any suitable calibration algorithm may be used.

For resonant pipe embodiments only straight pipes are recommended. Curves in the pipes can lead to poor resonance characteristics. For absorbent pipe embodiments straight pipes or pipes with curved sections are allowed. The curved sections, though, should only be used after a significant amount of absorption has taken place. Pipes with curved sections are useful where space is limited.

An embodiment using acoustic absorption is shown in FIG. 1, which shows an absorbent enablement with each section labeled with a letter and a length (110-118), under an embodiment. The headset mount 124 was placed about 57 cm from the loudspeaker 122 for this embodiment. Absorbing material (Bonded Absorbing Cotton (BAC) material 126 under the embodiment of FIG. 1) is contained in sections C 114, D 112 and E 110. The absorbing material 126 is wedged for about 15 cm at the end of Section C 114 nearest the headset to reduce reflections from the BAC. Five 2.0 inch inside diameter pipes 110-118 and four unions 120 are used and each pipe section (110-118) is designated by letters. In this embodiment, Section A (118) is 48.1 cm long, Section B (116) 16.8 cm, Section C (114) 48.1 cm, Section D (112) 27.7 cm, and Section E (110) 27.7 cm but the embodiment is not so limited. A cap 200, 300 may be positioned over the end of the embodiment opposite loudspeaker 122. Section lengths that have resulted in adequate performance are summarized in the table of FIG. 14 as further described below.

Figure 2:
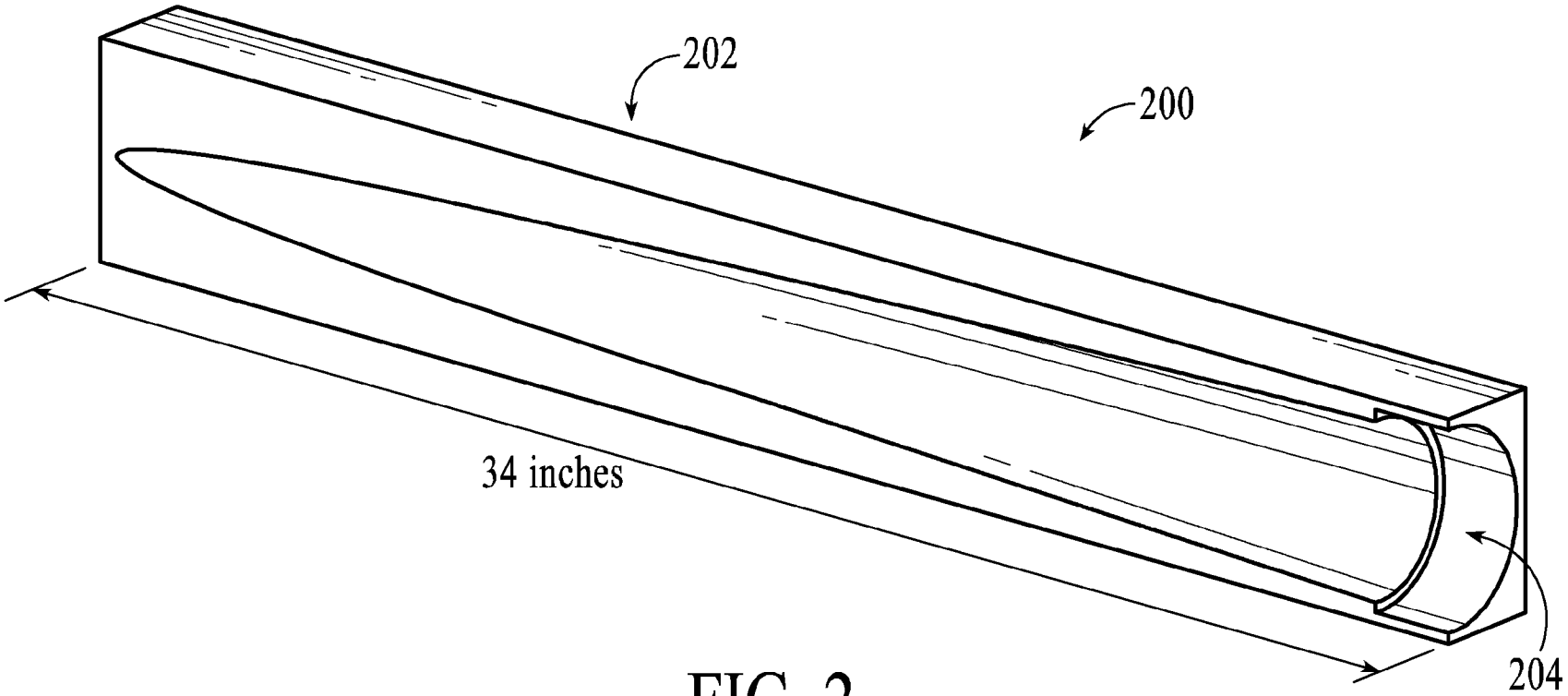
FIG. 2 is a cross-section of a CAD model for a linearly decreasing cross-sectional area four-inch inside diameter pipe end cap that widens the resonance widths by reflecting energy all along its length, under an embodiment.

For resonant embodiments, a tapered end cap is used where wider resonances are desired. A tapered end cap is one where the inside diameter of the pipe is configured such that there are multiple reflections from the cap. A smoothly tapering cap embodiment is shown in FIG. 2. Here the inside diameter changes linearly as a function of length, so that there are multiple reflections of energy along the length of the cap.

FIG. 2 shows a cross-section of a CAD model for a linearly decreasing cross-sectional area four-inch inside diameter pipe end cap 202, under an embodiment. This end cap 202 will widen the resonance widths by reflecting energy all along its length. Total tapered length of this embodiment is approximately 34 inches, but can vary from approximately 2 inches to more than 34 inches depending on the application. The indentation 204 at the end is a slip fit for a 4 inch I.D. pipe, and the slip fit is configured so that the transition between the pipe and the tapered end is as smooth as possible.

Figure 3:
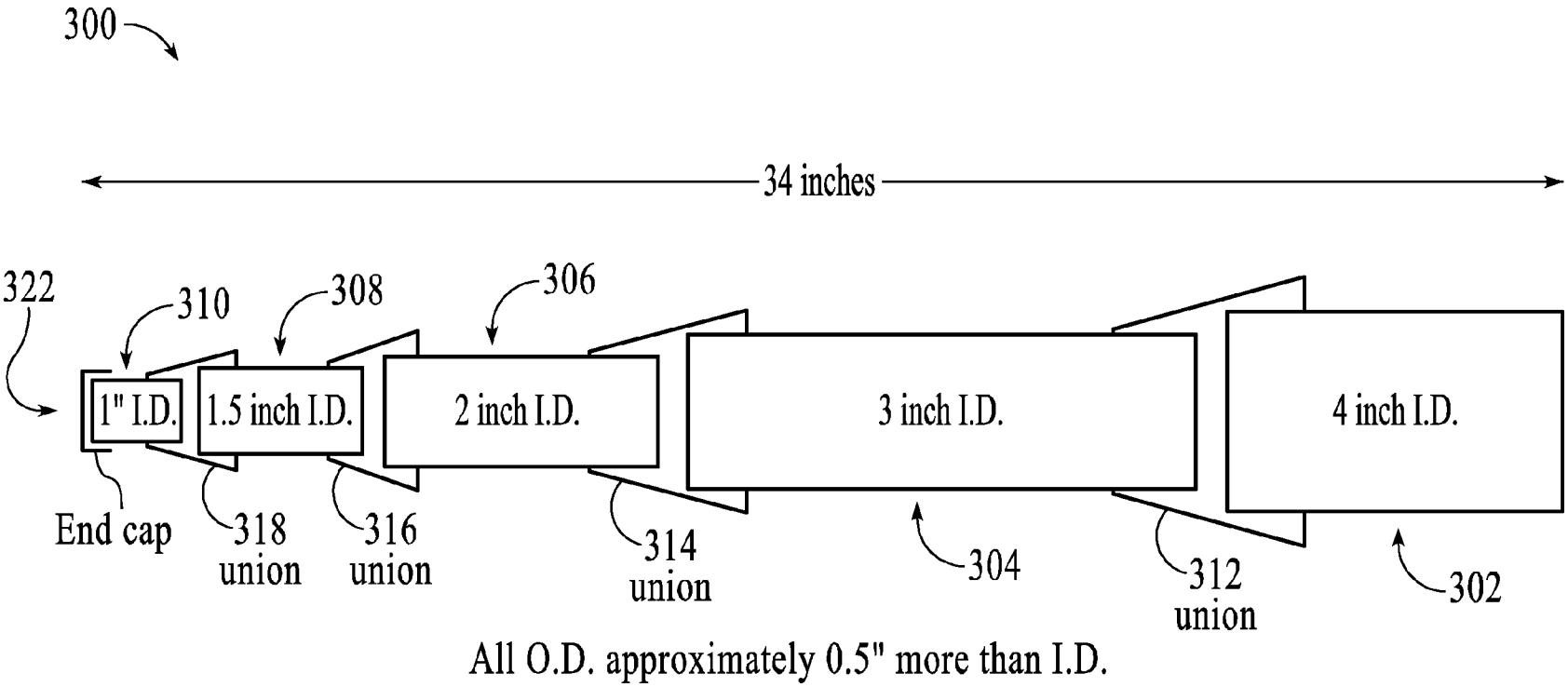
FIG. 3 shows a piecewise tapered approximation to the smoothly tapered end cap shown in FIG. 2 for a four-inch inside diameter pipe (approximately to scale), under an embodiment.

If constructing the smoothly tapering cap is too difficult and/or expensive, a piecewise approximation 322 can easily be constructed using reducers. The embodiment of FIG. 3 implements the piecewise approximation by joining five pipe sections 302-310 of decreasing I.D. dimensions. As shown in FIG. 3, sections 302, 304, 306, 308 and 310 exhibit I.D. dimensions of 4 inches, 3 inches, 2 inches, 1.5 inches, and 1 inch, respectively. The pipe sections 302-310 are joined using corresponding union components 312-318. The tapering cap 322 of the FIG. 3 embodiment is 34 inches in length but the embodiment is not so limited. Each time the inside diameter of the embodiment changes some of the acoustic energy is reflected. This configuration has the advantage of being simple and inexpensive to produce, but the number of additional reflections is limited. Both caps 200, 300 reduce the amplitude and increase the width of the resonances, which can make it simpler for calibration algorithms to work accurately.

As described above, FIG. 3 is a piecewise tapered approximation to the smoothly tapered end cap shown in FIG. 2 for a four-inch inside diameter pipe (approximately to scale), under an embodiment. This is simpler and less expensive to build, but does not broaden the plateaus as much as the smoothly tapered configuration.

FIG. 14 is a table of lengths of different sections 1410 for various combinations of straight pipes tested, the total length 1420 (not including loudspeaker and adapter), and the microphone sampling point 1430, under an embodiment. The sampling frequency was 4 kHz and the cutoff of the excitation used was 3700 Hz. The total length 1420 includes approximately 6 mm for each union used. A length of 0.0 cm indicates removal. As shown in FIG. 1, Section A 118 is the section closest to the loudspeaker and Section B 116 is the section where the headset mount is located. Sections C 114, D 112, and E 110 are all filled with the absorbent material 126. All comparisons were to the first combination. "Degraded" denotes a calibration that was significantly different than the semi-anechoic calculation, and "disturbances" indicate small (up to approximately 0.3 dB) differences in the frequency spectrum of $O_1$ and $O_2$ that were different than that recorded in the semi-anechoic chamber. Many different combinations are possible; this list is not exhaustive and is intended only to display the flexibility of the calibration methods of an embodiment.

Many combinations are possible, but the critical lengths are Sections A 118 and C 114. In practice, the headset needs to be about 30 cm away from the loudspeaker to minimize loudspeaker near-field effects on the results. Thus Section A 118 and B 116 should be sized so that the microphones are at least 30 cm from the loudspeaker. For Section C 114, for best performance enough absorbent material should be used so that the amount of acoustic energy returning to the headset from the far end of the pipe is at least 40 dB lower than the energy coming from the loudspeaker 122. This length will vary depending on the absorber. For this embodiment, the minimum length for good performance was about 48 cm. Multiple sections were used for the absorbent length to ease installation of the absorbent material 126. This particular configuration is recommended because it has demonstrated excellent accuracy, repeatability, noise robustness, and is not too long. Extra absorbent sections are allowable but generally not necessary. The use of less absorbent material than shown is possible if space is a consideration at the cost of slightly less noise robustness and increased risk of resonant spikes in the frequency spectrum.

The absorbent material 126 used was 2 inch thick Bonded Absorbent Cotton (BAC), available from Acoustical Surfaces Incorporated (part number EE224B3, phone number 800-448-9077) in four foot by two foot sheets. The sheets were cut into 2 inch strips that were 48 inches long, and then cut to length to fit each of the sections. The strips were fed into the sections, and double-sided tape was used to secure one side of the tape on both ends. Other means of securing the BAC 126 are possible (even using friction between the BAC 126 and the pipe itself) and the method of adhesion is not critical to the performance of the system. It is recommended that the BAC 126 be installed so that it is distributed uniformly in the pipe with no bunching of the material. It does not need to fill the pipe completely, but there should be no large gaps. It is also recommended that the end of the BAC 126 nearest the microphone sampling point be wedged so that reflections due to the change in impedance caused by the BAC 126 are minimized. Other absorbent material such as fiberglass can be used. The only important performance metric is that the reflections from the end of the pipe be minimized as stated above.

It is recommended for maximum performance that the three sections of absorbent pipe be oriented so that their taped surfaces are opposite one another. That is, Section C 114 is rotated so that the taped wedge side is opposite the microphones and Section D 112 is rotated so that its taped surface is opposite that of Sections C 114 and E 110.

Figure 4:
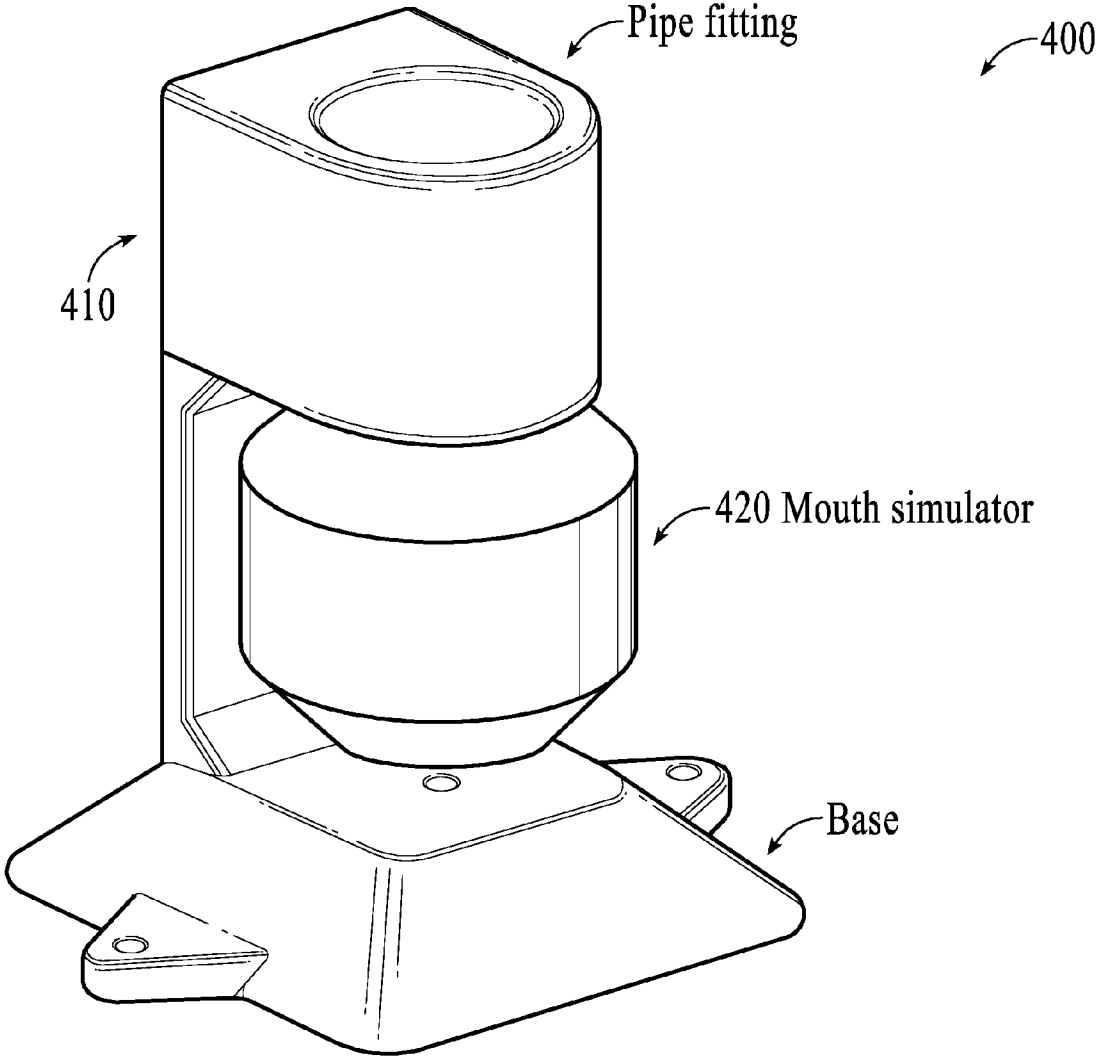
FIG. 4 shows the pipe-to-loudspeaker adapter used for the enablement tests, under an embodiment.

FIG. 4 shows the pipe-to-loudspeaker adapter 410 (PLA), under an embodiment. It is configured for use with a Bruel and Kjaer Mouth Simulator 420, model 4227, but any suitable loudspeaker may be used. The Bruel and Kjaer mouth simulator 420 loudspeaker is shown in place, and is held there with two bolts—one through the base and the other through the back of the adapter (not seen here). The PLA 410 uses a rubber O-ring to seal the surface of the loudspeaker against the surface of the PLA 410, and a slip fit to seal the pipe at the other end. The pipe may be glued to the PLA 410 as well. Two nylon bolts with metal nuts are used to hold the Mouth Simulator 420 in place. Any PLA 410 which holds the loudspeaker and the pipe in a fixed position may be used.

When using the Bruel and Kjaer Mouth Simulator 420 model 4227, it is recommended that Section A 118 be at least approximately 28 cm long to reduce near-field effects that can cause the calibration filter to be inaccurate at certain frequencies. For best performance, approximately 48.1 cm is recommended, but for most applications approximately 28 cm is sufficient. Lengths down to 0 cm were tested for Section A 118, with the best performance observed between approximately 28 and 48.1 cm.

Figure 5:
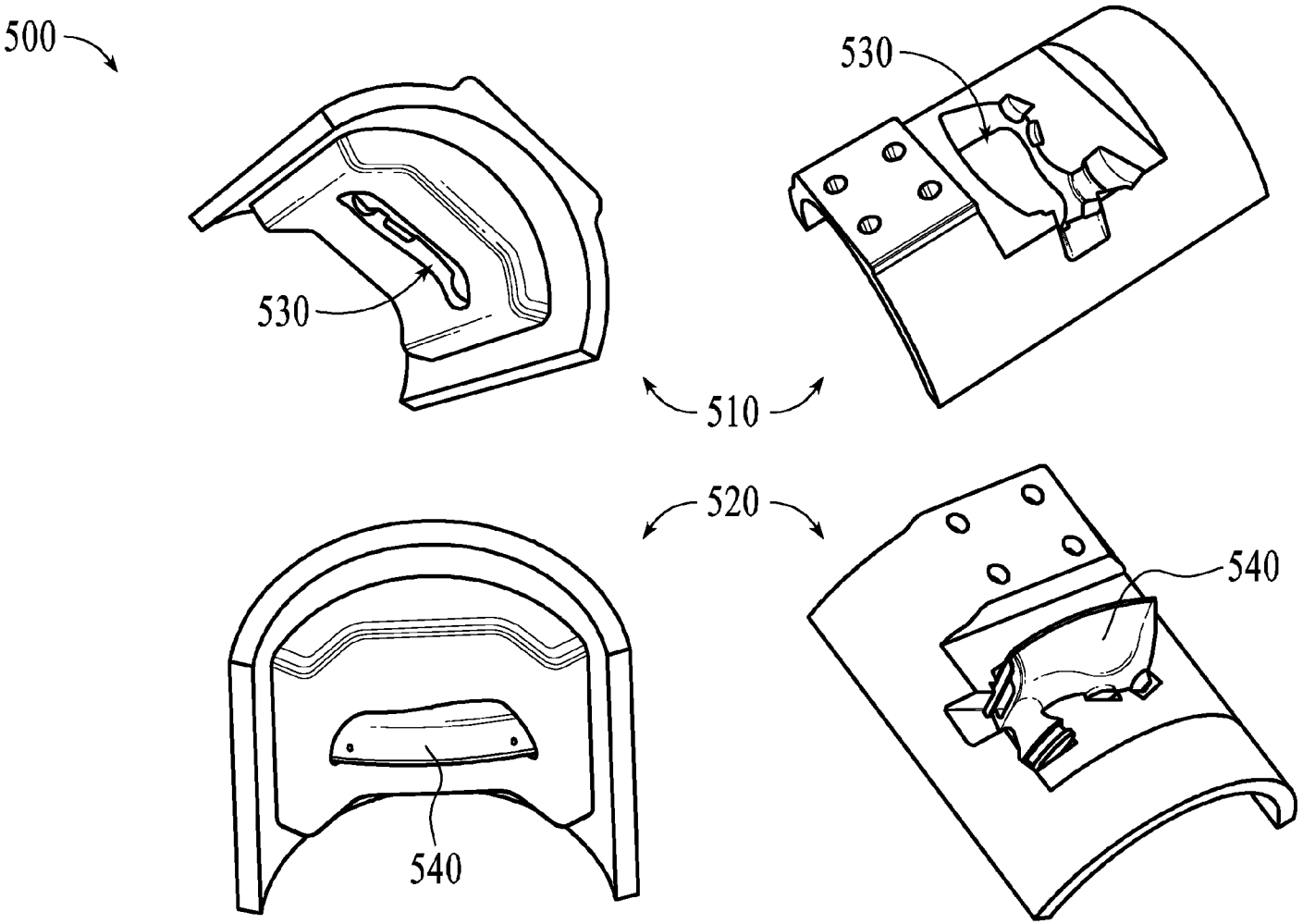
FIG. 5 shows different views of the headset mount used with and without the headset in place, under an embodiment.

Testing was done using the Aliph Jawbone Icon headset, available at http://www.jawbone.com. The Icon includes two omnidirectional microphones situated approximately 25 mm apart and calibration is performed for operation. A mount was constructed that held the Icon so that each microphone was at the same relative distance from the pipe wall (approximately 5 mm) and the same distance from the loudspeaker. FIG. 5 shows several views of the headset mount used in the embodiments with 520 and without 510 the headset in place, under an embodiment. A hole 530 was cut into the pipe wall just large enough so that the mount fit precisely into the hole and the headset 540 was placed in its receptacle and held in place using a toggle clamp with a firm foam piece glued to the end of the clamp to hold it securely in place. The two microphones of the headset were approximately 5 mm inside the inside surface of the pipe and an equal distance from the loudspeaker end of the pipe. Data was recorded using sampling rates of 8 kHz and 16 kHz. Calibration filters were calculated using a 16-subband LMS adaptive filter algorithm, using $O_1$ (the front microphone) as the desired signal.

Figure 6:
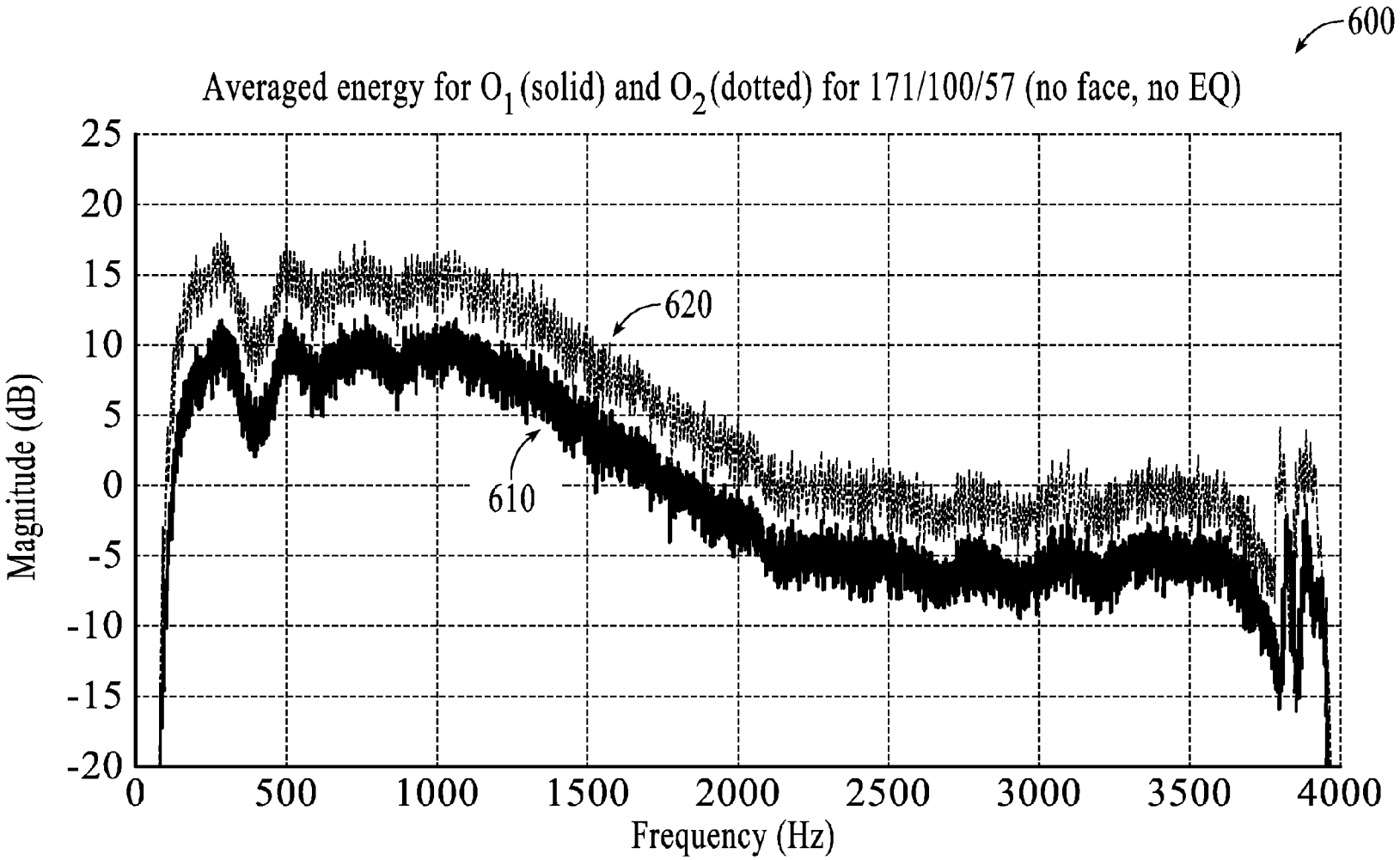
FIG. 6 is a plot of averaged energy versus frequency for $O_1$ (solid) and $O_2$ (dotted) for headset 2259 in the absorbent embodiment with no equalization, under an embodiment.

FIG. 6 shows a plot of the averaged energy calculated using the Fast Fourier Transform (FFT) versus frequency data for $O_1$ (solid) 610 and $O_2$ (dotted) 620 using test headset 2259 in the absorbent embodiment with no equalization, under an embodiment. The excitation has not been whitened for this experiment. The microphone (energy) responses are relatively smooth (there are no significant resonances, as would normally be expected inside a pipe, due to the absorbent material) and relatively similar in energy.

Figure 7:
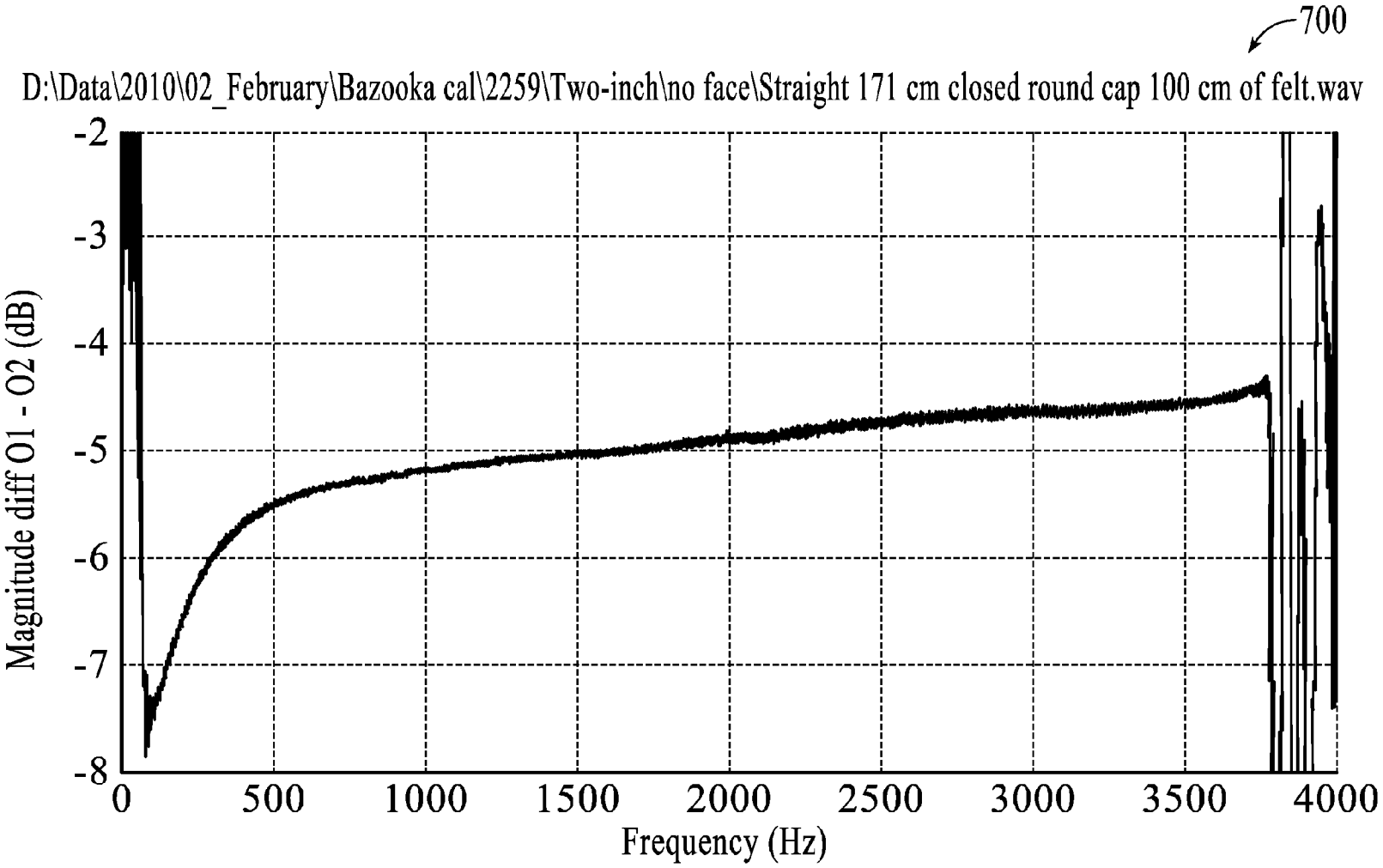
FIG. 7 is a plot of the differences in the plots in FIG. 6, under an embodiment.

FIG. 7 shows a plot of the difference in the energy versus frequency data of $O_1$ and $O_2$, under an embodiment. The difference in the frequency response of the two microphones $O_1$ and $O_2$ is relatively smooth throughout the usable spectrum (approximately 100 to 3750 Hz), with no jumps or discontinuities.

Figure 8:
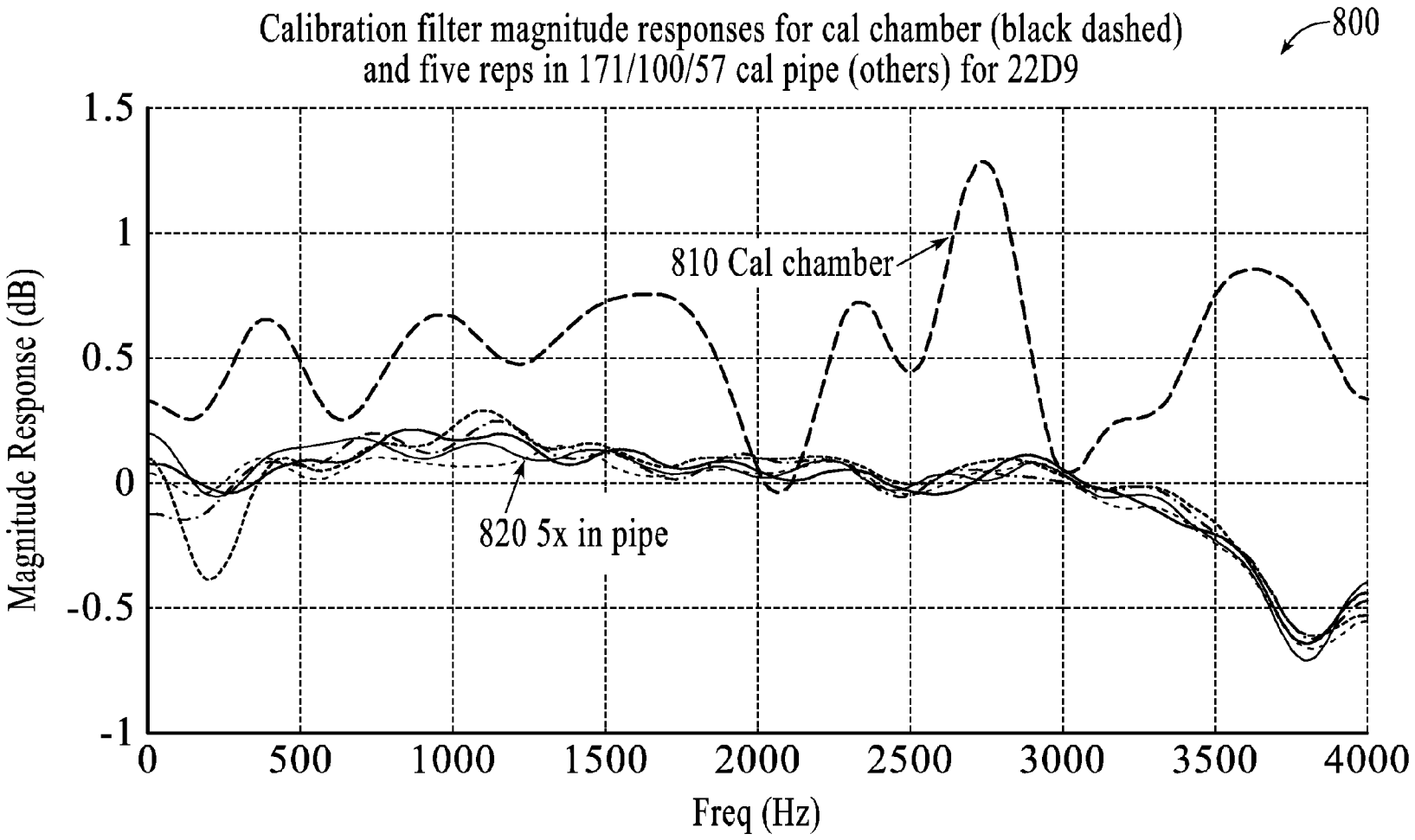
FIG. 8 is a plot of calibration filter magnitude responses for a conventional calibration chamber (black dashed) and five repetitions in the absorbent embodiment (all others) for headset 22D9, under an embodiment.

FIG. 8 shows a plot of the magnitude response of the calibration filter derived from the $O_1$ and $O_2$ data, under an embodiment. The amplitude response is derived using a conventional calibration chamber denoted using a dashed black plot 810 and five remove-and-replace repetitions 820 in the absorbent pipe embodiment included for comparison, for headset 22D9. Note the relatively large ripple and offset in magnitude when using the conventional calibration chamber 810, and the tight grouping of the remove-and-replace pipe calibration 820. The performance of the pipe-calibrated headset was significantly better than the calibration chamber headset.

Figure 9:
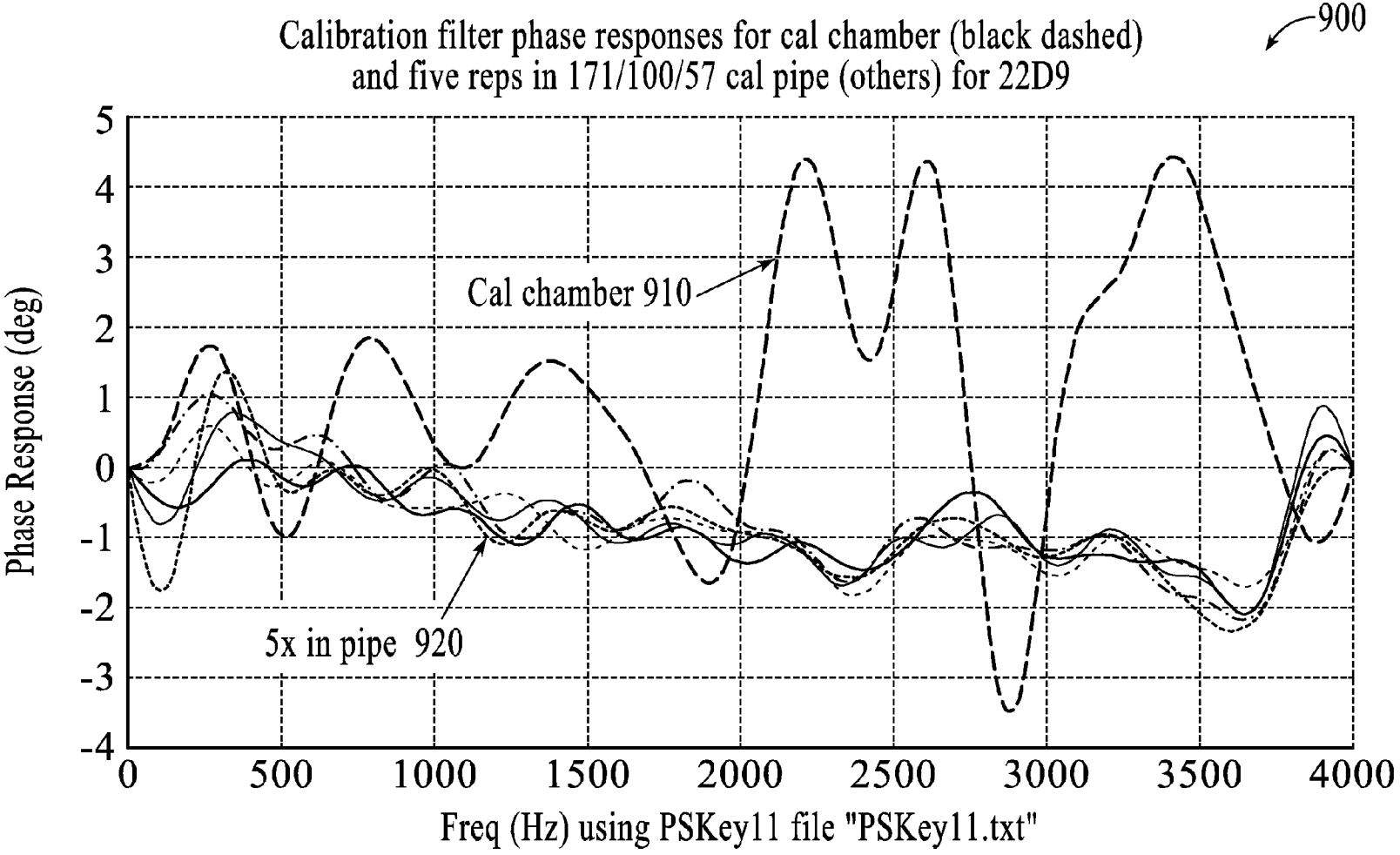
FIG. 9 is a plot of calibration filter phase responses for a conventional calibration chamber (black dashed) and five repetitions in the absorbent embodiment (all others) for headset 22D9, under an embodiment.

FIG. 9 shows the calibration filter phase responses for the conventional calibration chamber (black dashed) 910 and five repetitions in the absorbent embodiment (all others) 920 for headset 22D9, under an embodiment. Again, the conventional calibration chamber result (black dashed) 910 has a relatively larger ripple than the pipe calibrations, and a tight grouping is present with the remove-and-replace pipe calibration 920. For both magnitude and phase, the pipe calibrations have fewer ripples and excellent repeatability. Using the same headset, significantly higher noise suppression performance was noted when using any of the pipe calibrations compared to the conventional calibration chamber calibration. This indicates that not only is the pipe calibration relatively smoother with fewer ripples, it is also relatively more accurate.

Figure 10:
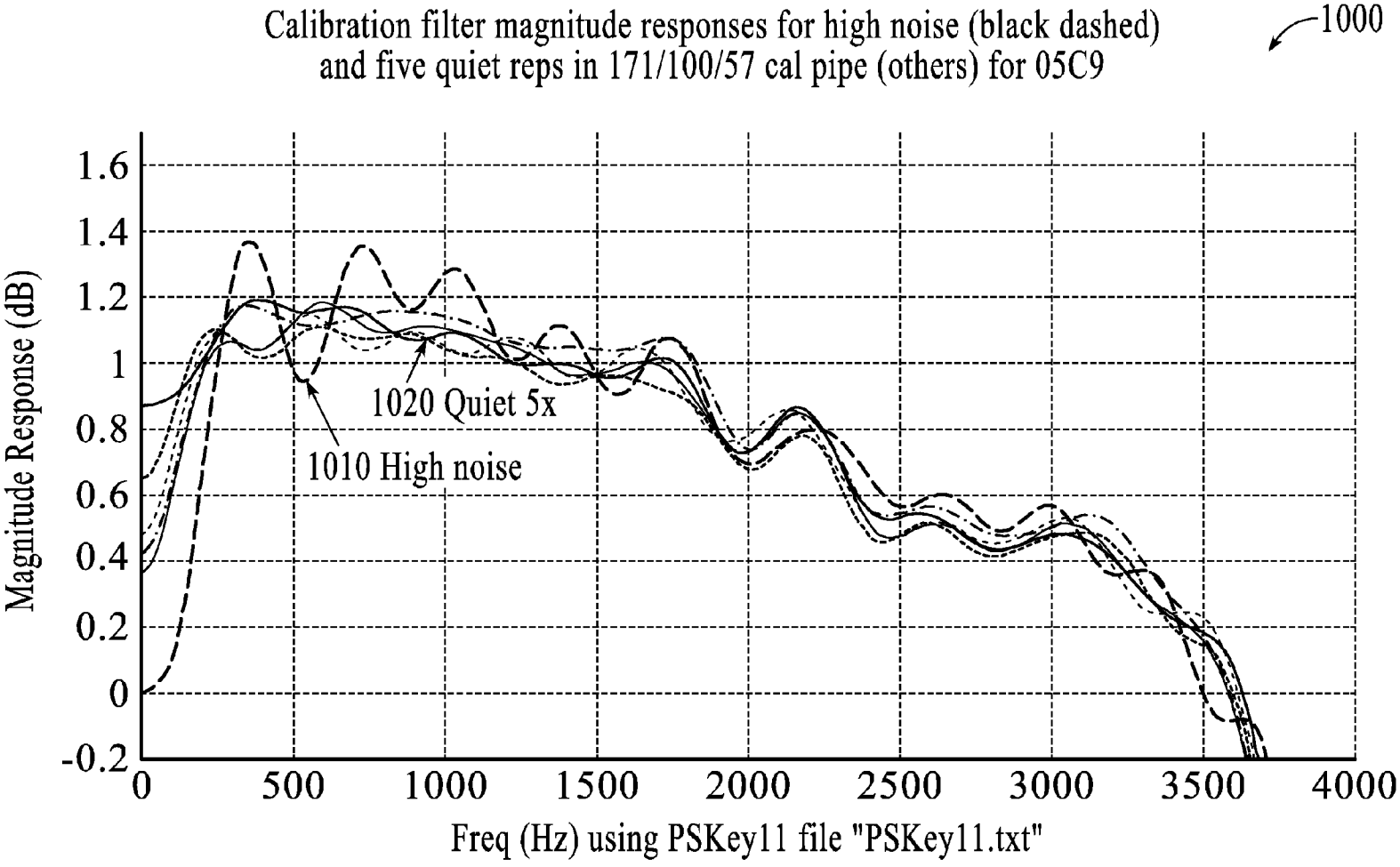
FIG. 10 is a plot of calibration filter magnitude responses for high factory noise simulation (black dashed) and five repetitions in quiet (all others) for the absorbent pipe embodiment using headset 05C9, under an embodiment.

As a test to the noise resistance of the configuration, a large subwoofer was used to drive a recorded factory noise pink signal (most energy was below 200 Hz) at 81 dBA as measured at the headset. This level is much higher than is actually experienced in the factory in which it was recorded. FIG. 10 shows the resulting magnitude responses of the calibration filter for the absorbent pipe embodiment using test headset 05C9, under an embodiment. The relatively high noise simulation is denoted using the black dashed line 1010, and five remove-and-replace repetitions 1020 in quiet are included for comparison. Note only a relatively small (approximately +−0.2 dB) increase in ripple at low frequencies in this very high noise simulation.

Figure 11:
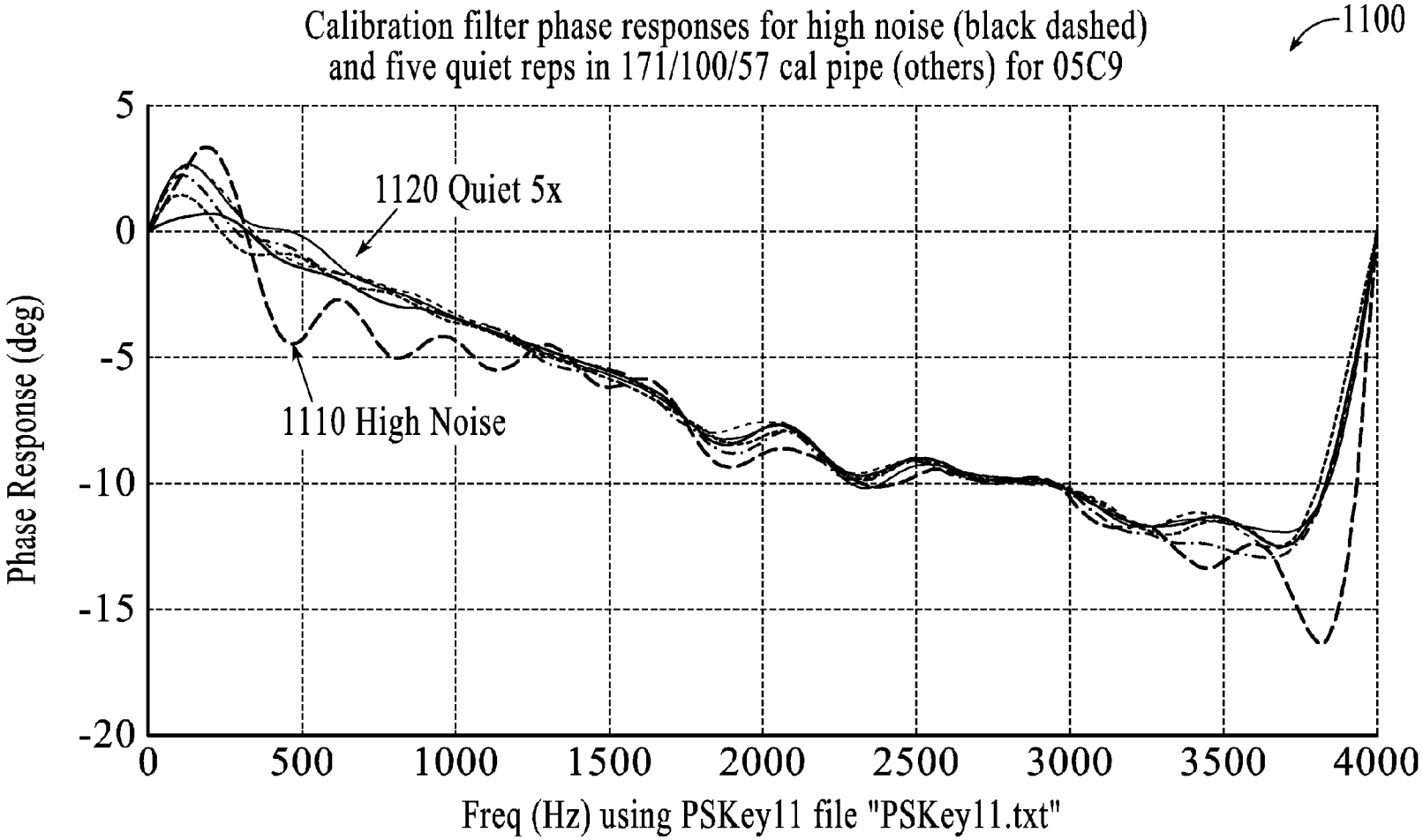
FIG. 11 is a plot of calibration filter phase responses for high factory noise simulation (black dashed) and five repetitions in quiet (all others) for the absorbent pipe embodiment using headset 05C9, under an embodiment.

FIG. 11 shows the calibration filter phase responses for relatively high factory noise simulation (black dashed) 1110 and five repetitions in quiet (all others) 1120 for the absorbent pipe embodiment using headset 05C9, under an embodiment. There is slightly more ripple (only a small (approximately +−3 degrees) increase in ripple at low frequencies in this relatively very high noise simulation) and some disturbances due to the very high noise levels, but overall the performance is still very good and there were little differences noted in the performance of the headset using noisy and quiet calibrations.

A second embodiment uses the same configuration as the embodiment described above, but does not use the absorbent BAC. The result is a more reverberant environment, but one that is very resistant to external noise. Any noise that does get into the pipe only serves to add to the reverberation being generated by the loudspeaker and does not significantly affect the relative amplitude or phase presented to the microphones. Thus, this configuration may be used in almost any noise environment.

Figure 12:
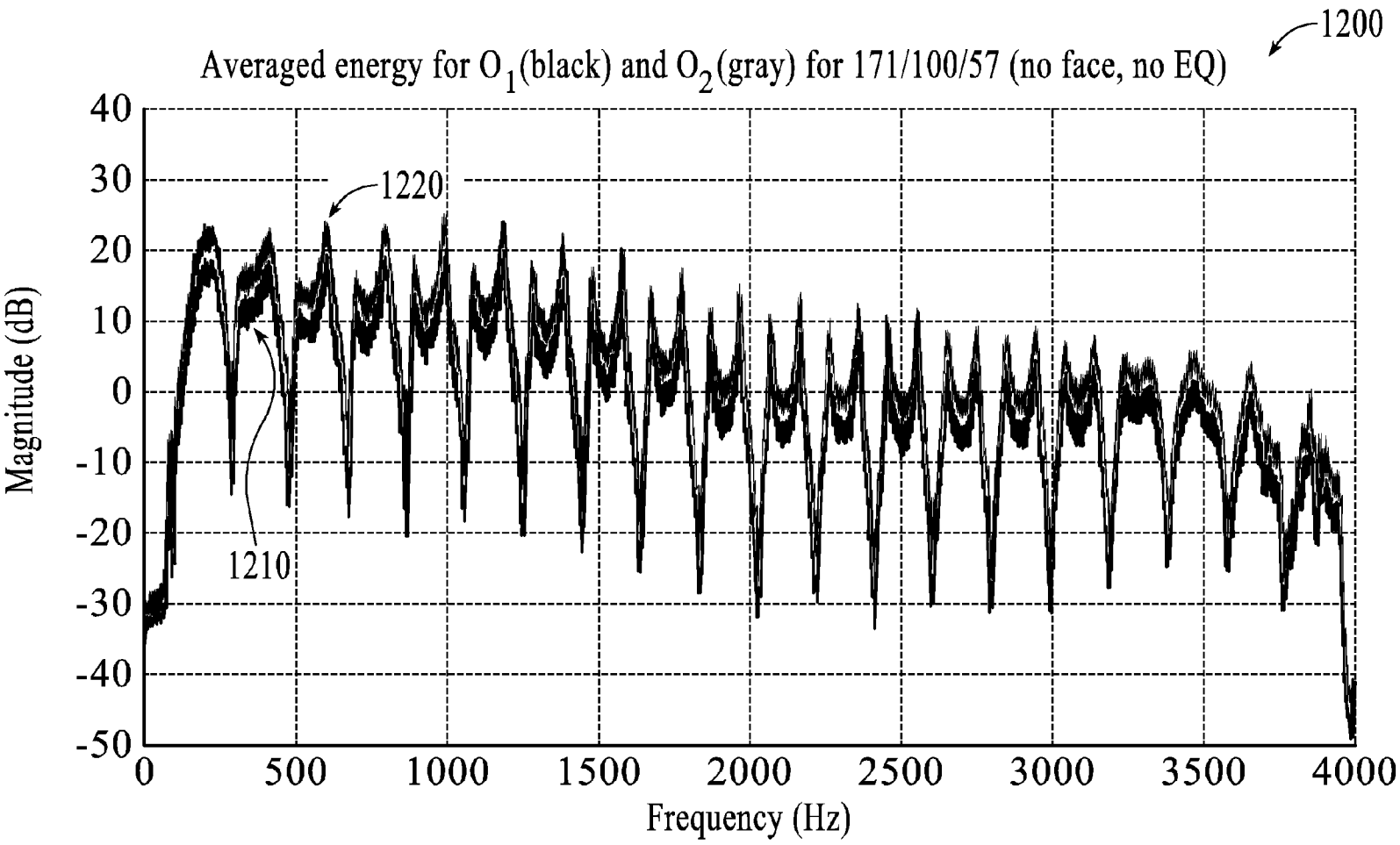
FIG. 12 is a plot of averaged energy versus frequency for $O_1$ (black) and $O_2$ (gray) for headset 2259 in the reverberant embodiment with no equalization, under an embodiment.

FIG. 12 shows a plot of the averaged energy calculated using the Fast Fourier Transform (FFT) versus frequency data for $O_1$ (black) 1210 and $O_2$ (gray) 1220 using test headset 0C59 in the reverberant embodiment with no equalization, under an embodiment. Significant resonances are present (compare to FIG. 6) but the peak locations are approximately the same and consistent in height, and the energy at the null locations exhibits some differences.

Figure 13:
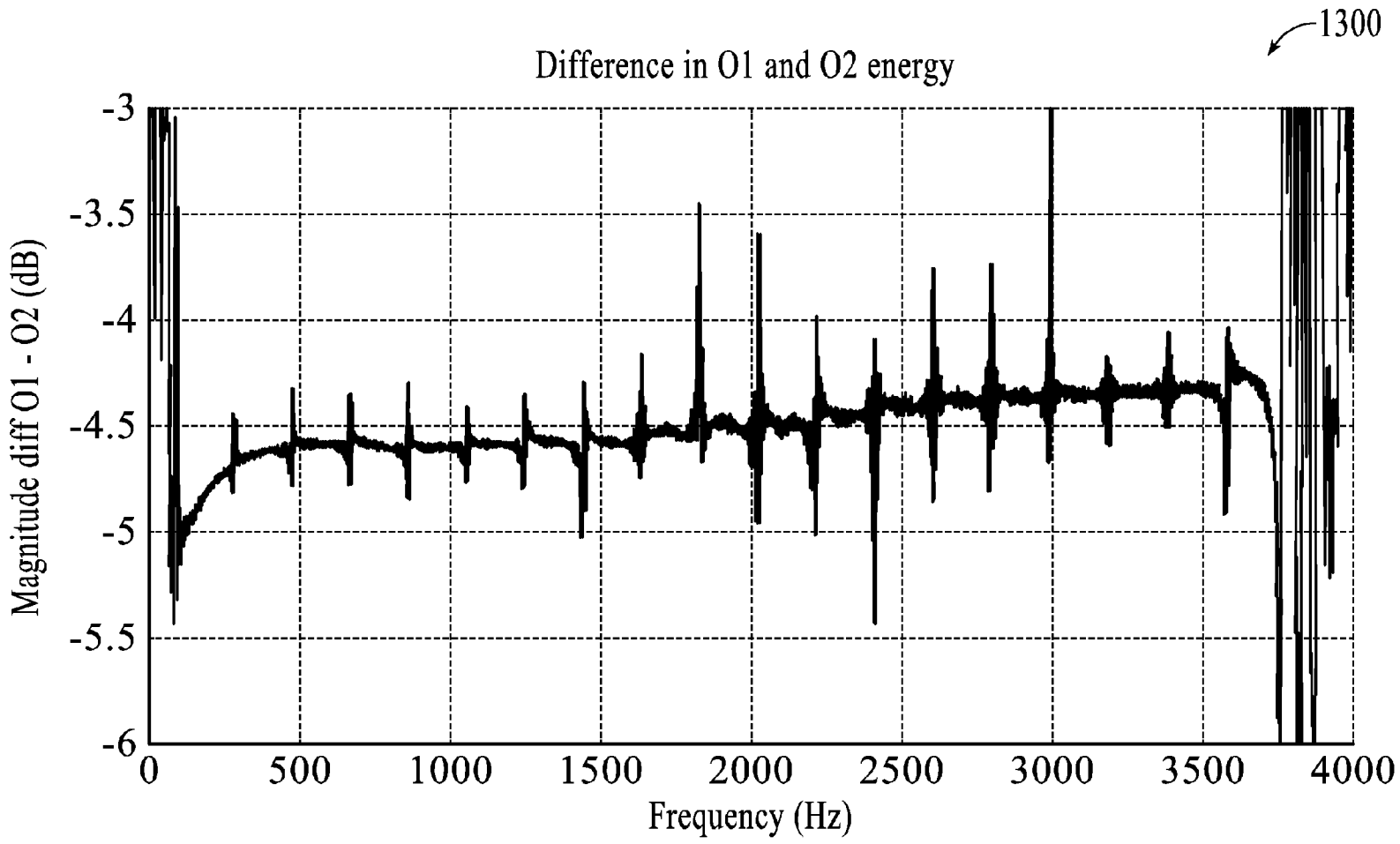
FIG. 13 is a plot of the differences in the plots in FIG. 12, under an embodiment.

This is made clear in FIG. 13, which shows a plot of the difference in the energy versus frequency (differences in plots 1210, 1220 of FIG. 12), under an embodiment. At the resonance locations, the differences are consistent, but near the nulls the differences can vary by up to approximately 1.5 dB. However, since most calibration algorithms use the frequencies with the most energy to calculate the calibration filters, this should not prove an undue burden on the calibration algorithm.

Embodiments described herein include a device comprising a pipe that includes at least one section that spans between a first end and a second end of the pipe. The pipe has a cylindrical cross-section. The device comprises a receptacle positioned in the pipe a first distance from the first end and a second distance from the second end. The receptacle receives an electronic device having a plurality of microphones that are to be calibrated and secures the at least one microphone a third distance inside an inside surface of the pipe. The device comprises an adapter connected to the first end. The adapter connects a loudspeaker to the pipe. The pipe controls an acoustic energy experienced by the plurality of microphones so that each microphone of the plurality of microphones receives equivalent acoustic energy.

Embodiments described herein include a device comprising: a pipe comprising at least one section that spans between a first end and a second end of the pipe, wherein the pipe has a cylindrical cross-section; a receptacle positioned in the pipe a first distance from the first end and a second distance from the second end, wherein the receptacle receives an electronic device having a plurality of microphones that are to be calibrated and secures the at least one microphone a third distance inside an inside surface of the pipe; an adapter connected to the first end, wherein the adapter connects a loudspeaker to the pipe, wherein the pipe controls an acoustic energy experienced by the plurality of microphones so that each microphone of the plurality of microphones receives equivalent acoustic energy.

The at least one section comprises a single section.

The at least one section comprises a plurality of sections.

The plurality of sections comprises five sections.

A first section comprises the first end, a second section is coupled to the first section and comprises the receptacle, and a fifth section comprises the second end.

The device includes a third section coupled to the second section, wherein the first section and the third section have an equivalent length.

A length of the first section and the third section is approximately 48 centimeters.

A length of the second section is approximately 17 centimeters.

The device includes a fourth section coupled to the third section, wherein the fifth section is coupled to the fourth section, wherein the fourth section and the fifth section have an equivalent length.

A length of the fourth section and the fifth section is approximately 28 centimeters.

The device includes an absorbing material positioned between the receptacle and the second end of the pipe.

The absorbing material is positioned inside at least a portion of the pipe comprising the third section, the fourth section, and the fifth section.

The absorbing material in the third section is wedged at an end nearest the receptacle.

The first distance is approximately 57 centimeters.

The plurality of sections comprises four sections.

A first section comprises the first end, and a second section is coupled to the first section and comprises the receptacle.

A length of the second section is approximately 17 centimeters.

The device includes a third section coupled to the second section.

A length of the third section is approximately 48 centimeters.

The device includes a fourth section coupled to the third section, wherein the first section and the fourth section have an equivalent length.

A length of the first section and the fourth section is approximately 28 centimeters.

The first distance is approximately 37 centimeters.

The plurality of sections comprises three sections.

A first section comprises the first end, and a second section is coupled to the first section and comprises the receptacle.

A length of the second section is approximately 17 centimeters.

The device includes a third section coupled to the second section, wherein the first section and the third section have an equivalent length.

A length of the first section and the third section is approximately 48 centimeters.

The first distance is approximately 57 centimeters.

A length of the first section and the third section is approximately 28 centimeters.

The first distance is approximately 37 centimeters.

The device includes a third section coupled to the second section, wherein the first section and the third section have different lengths.

A length of the first section is approximately 48 centimeters.

A length of the third section is approximately 28 centimeters.

A length of the second section is approximately 17 centimeters.

The first distance is approximately 57 centimeters.

A length of the first section is approximately 28 centimeters.

A length of the third section is approximately 48 centimeters.

A length of the second section is approximately 17 centimeters.

The first distance is approximately 37 centimeters.

A length of the first section is approximately 15 centimeters.

A length of the third section is approximately 28 centimeters.

A length of the second section is approximately 17 centimeters.

The first distance is approximately 24 centimeters.

A first section comprises the first end and the receptacle.

The device includes a second section coupled to the first section, and a third section coupled to the second section, wherein the third section comprises the second end.

A length of the first section is approximately 17 centimeters.

A length of the second section is approximately 48 centimeters.

A length of the third section is approximately 28 centimeters.

The first distance is approximately 8 centimeters.

The plurality of sections comprises two sections.

A first section comprises the first end and the receptacle.

The device includes a second section coupled to the first section, wherein the second section comprises the second end.

A length of the first section is approximately 17 centimeters.

A length of the second section is approximately 48 centimeters.

The first distance is approximately 8 centimeters.

A length of the second section is approximately 28 centimeters.

The first distance is approximately 8 centimeters.

The first distance is at least 30 centimeters.

The second end is open.

The second end is coupled to a cap, wherein the cap closes the second end.

The cap is tapered.

An inside diameter of the cap changes linearly as a function of a length of the cap.

The length of the cap is in a approximately in a range of two (2) inches to 34 inches.

An inside diameter of the pipe is approximately in a range of two (2) inches to four (4) inches.

The third distance is approximately in a range of two (2) to five (5) millimeters.

The receptacle locates each microphone of the plurality of microphones an equal distance from the loudspeaker.

An absorbing material positioned inside at least a portion of the pipe.

The absorbing material is positioned between the receptacle and the second end of the pipe.

The absorbing material is wedged at an end nearest the receptacle.

An amount of the absorbing material is an amount that lowers an amount of reflected acoustic energy returning to the plurality of microphones from the second end at least 40 decibels lower than acoustic energy projected from the first end.

The absorbing material comprises bonded absorbent cotton.

The loudspeaker is a mouth simulator loudspeaker.

The at least one section is straight.

The at least one section is curved.

The equivalent acoustic energy comprises equivalent amplitude and phase.

Embodiments described herein include a system comprising a pipe that includes a first end and a second end. The pipe includes a plurality of sections coupled together. The system includes a loudspeaker that is a mouth simulator loudspeaker. The system includes an adapter that connects the loudspeaker to the first end. The system includes a receptacle positioned in the pipe a first distance from the first end and a second distance from the second end. The receptacle secures a plurality of microphones a third distance inside an inside surface of the pipe.

Embodiments described herein include a system comprising a pipe that includes a first end and a second end, and including a plurality of sections coupled together; a loudspeaker that is a mouth simulator loudspeaker; an adapter that connects the loudspeaker to the first end; and a receptacle positioned in the pipe a first distance from the first end and a second distance from the second end, wherein the receptacle secures a plurality of microphones a third distance inside an inside surface of the pipe.

The pipe has a cylindrical cross-section.

The system includes an electrical signal coupled to the loudspeaker, wherein the electrical signal is equalized.

The system includes a recorder coupled to an output of the plurality of microphones, wherein the recorder records the output.

The system includes a calibration processing application running on a processor coupled to the recorder, wherein the calibration processing application generates at least one calibration filter.

The at least one calibration filter is coupled to the output of the plurality of microphones, wherein the at least one calibration filter includes coefficients that filter an output of each microphone so that an amplitude and phase of the plurality of microphones are approximately equal in response to an identical input.

The plurality of sections comprises five sections.

A first section comprises the first end, a second section is coupled to the first section and comprises the receptacle, and a fifth section comprises the second end.

The system includes a third section coupled to the second section, wherein the first section and the third section have an equivalent length.

A length of the first section and the third section is approximately 48 centimeters.

A length of the second section is approximately 17 centimeters.

The system includes a fourth section coupled to the third section, wherein the fifth section is coupled to the fourth section, wherein the fourth section and the fifth section have an equivalent length.

A length of the fourth section and the fifth section is approximately 28 centimeters.

The system includes an absorbing material positioned between the receptacle and the second end of the pipe.

The absorbing material is positioned inside at least a portion of the pipe comprising the third section, the fourth section, and the fifth section.

The absorbing material in the third section is wedged at an end nearest the receptacle.

The first distance is approximately 57 centimeters.

The plurality of sections comprises four sections.

A first section comprises the first end, and a second section is coupled to the first section and comprises the receptacle.

A length of the second section is approximately 17 centimeters.

The system includes a third section coupled to the second section.

A length of the third section is approximately 48 centimeters.

The system includes a fourth section coupled to the third section, wherein the first section and the fourth section have an equivalent length.

A length of the first section and the fourth section is approximately 28 centimeters.

The first distance is approximately 37 centimeters.

The plurality of sections comprises three sections.

A first section comprises the first end, and a second section is coupled to the first section and comprises the receptacle.

A length of the second section is approximately 17 centimeters.

The system includes a third section coupled to the second section, wherein the first section and the third section have an equivalent length.

A length of the first section and the third section is approximately 48 centimeters.

The first distance is approximately 57 centimeters.

A length of the first section and the third section is approximately 28 centimeters.

The first distance is approximately 37 centimeters.

The system includes a third section coupled to the second section, wherein the first section and the third section have different lengths.

A length of the first section is approximately 48 centimeters.

A length of the third section is approximately 28 centimeters.

A length of the second section is approximately 17 centimeters.

The first distance is approximately 57 centimeters.

A length of the first section is approximately 28 centimeters.

A length of the third section is approximately 48 centimeters.

A length of the second section is approximately 17 centimeters.

The first distance is approximately 37 centimeters.

A length of the first section is approximately 15 centimeters.

A length of the third section is approximately 28 centimeters.

A length of the second section is approximately 17 centimeters.

The first distance is approximately 24 centimeters.

A first section comprises the first end and the receptacle.

The system includes a second section coupled to the first section, and a third section coupled to the second section, wherein the third section comprises the second end.

A length of the first section is approximately 17 centimeters.

A length of the second section is approximately 48 centimeters.

A length of the third section is approximately 28 centimeters.

The first distance is approximately 8 centimeters.

The plurality of sections comprises two sections.

A first section comprises the first end and the receptacle.

The system includes a second section coupled to the first section, wherein the second section comprises the second end.

A length of the first section is approximately 17 centimeters.

A length of the second section is approximately 48 centimeters.

The first distance is approximately 8 centimeters.

A length of the second section is approximately 28 centimeters.

The first distance is approximately 8 centimeters.

The first distance is at least 30 centimeters.

The second end is open.

The second end is coupled to a cap, wherein the cap closes the second end.

The cap is tapered.

An inside diameter of the cap changes linearly as a function of a length of the cap.

The length of the cap is in a approximately in a range of two (2) inches to 34 inches.

An inside diameter of the pipe is approximately in a range of two (2) inches to four (4) inches.

The third distance is approximately in a range of two (2) to five (5) millimeters.

The receptacle locates each microphone of the plurality of microphones an equal distance from the loudspeaker.

The system includes an absorbing material positioned inside at least a portion of the pipe.

The absorbing material is positioned between the receptacle and the second end of the pipe.

The absorbing material is wedged at an end nearest the receptacle.

An amount of the absorbing material is an amount that lowers an amount of reflected acoustic energy returning to the plurality of microphones from the second end at least 40 decibels lower than acoustic energy projected from the first end.

The absorbing material comprises bonded absorbent cotton.

The plurality of sections is straight.

At least one section of the plurality of sections is curved.

Embodiments described herein include a method comprising forming a pipe including a first end and a second end by forming couplings between a plurality of sections of pipe. The method comprises connecting a loudspeaker to the first end. The loudspeaker is a mouth simulator loudspeaker. The method comprises securing a plurality of microphones a third distance inside an inside surface of the pipe using a receptacle positioned in the pipe a first distance from the first end and a second distance from the second end. The method comprises generating an acoustic output at the loudspeaker. The method comprises generating at least one calibration filter using outputs of the plurality of microphones produced in response to the acoustic output.

Embodiments described herein include a method comprising: forming a pipe comprising a first end and a second end by forming couplings between a plurality of sections of pipe; connecting a loudspeaker to the first end, wherein the loudspeaker is a mouth simulator loudspeaker; securing a plurality of microphones a third distance inside an inside surface of the pipe using a receptacle positioned in the pipe a first distance from the first end and a second distance from the second end; generating an acoustic output at the loudspeaker; and generating at least one calibration filter using outputs of the plurality of microphones produced in response to the acoustic output.

The method comprises coupling the at least one calibration filter to the output of the plurality of microphones, wherein the at least one calibration filter includes coefficients that filter an output of each microphone so that an amplitude and phase of the plurality of microphones are approximately equal in response to an identical input.

The forming of the pipe comprising forming the pipe with a cylindrical cross-section.

Forming couplings between a plurality of sections of pipe comprises forming couplings between the plurality of sections including five sections.

A first section comprises the first end, a second section is coupled to the first section and comprises the receptacle, and a fifth section comprises the second end.

The method comprises a third section coupled to the second section, wherein the first section and the third section have an equivalent length.

A length of the first section and the third section is approximately 48 centimeters.

A length of the second section is approximately 17 centimeters.

The method comprises a fourth section coupled to the third section, wherein the fifth section is coupled to the fourth section, wherein the fourth section and the fifth section have an equivalent length.

A length of the fourth section and the fifth section is approximately 28 centimeters.

The method comprises positioning an absorbing material between the receptacle and the second end of the pipe.

The method comprises positioning the absorbing material inside at least a portion of the pipe comprising the third section, the fourth section, and the fifth section.

The method comprises wedging the absorbing material in the third section at an end nearest the receptacle.

The first distance is approximately 57 centimeters.

Forming couplings between a plurality of sections of pipe comprises forming couplings between the plurality of sections including four sections.

A first section comprises the first end, and a second section is coupled to the first section and comprises the receptacle.

A length of the second section is approximately 17 centimeters.

The method comprises a third section coupled to the second section.

A length of the third section is approximately 48 centimeters.

The method comprises a fourth section coupled to the third section, wherein the first section and the fourth section have an equivalent length.

A length of the first section and the fourth section is approximately 28 centimeters.

The first distance is approximately 37 centimeters.

Forming couplings between a plurality of sections of pipe comprises forming couplings between the plurality of sections including three sections.

A first section comprises the first end, and a second section is coupled to the first section and comprises the receptacle.

A length of the second section is approximately 17 centimeters.

The method comprises a third section coupled to the second section, wherein the first section and the third section have an equivalent length.

A length of the first section and the third section is approximately 48 centimeters.

The first distance is approximately 57 centimeters.

A length of the first section and the third section is approximately 28 centimeters.

The first distance is approximately 37 centimeters.

The method comprises a third section coupled to the second section, wherein the first section and the third section have different lengths.

A length of the first section is approximately 48 centimeters.

A length of the third section is approximately 28 centimeters.

A length of the second section is approximately 17 centimeters.

The first distance is approximately 57 centimeters.

A length of the first section is approximately 28 centimeters.

A length of the third section is approximately 48 centimeters.

A length of the second section is approximately 17 centimeters.

The first distance is approximately 37 centimeters.

A length of the first section is approximately 15 centimeters.

A length of the third section is approximately 28 centimeters.

A length of the second section is approximately 17 centimeters.

The first distance is approximately 24 centimeters.

A first section comprises the first end and the receptacle.

The method comprises a second section coupled to the first section, and a third section coupled to the second section, wherein the third section comprises the second end.

A length of the first section is approximately 17 centimeters.

A length of the second section is approximately 48 centimeters.

A length of the third section is approximately 28 centimeters.

The first distance is approximately 8 centimeters.

Forming couplings between a plurality of sections of pipe comprises forming couplings between the plurality of sections including two sections.

A first section comprises the first end and the receptacle.

The method comprises a second section coupled to the first section, wherein the second section comprises the second end.

A length of the first section is approximately 17 centimeters.

A length of the second section is approximately 48 centimeters.

The first distance is approximately 8 centimeters.

A length of the second section is approximately 28 centimeters.

The first distance is approximately 8 centimeters.

The first distance is at least 30 centimeters.

The second end is open.

The second end is coupled to a cap, wherein the cap closes the second end.

The cap is tapered.

An inside diameter of the cap changes linearly as a function of a length of the cap.

The length of the cap is in a approximately in a range of two (2) inches to 34 inches.

An inside diameter of the pipe is approximately in a range of two (2) inches to four (4) inches.

The third distance is approximately in a range of two (2) to five (5) millimeters.

The receptacle locates each microphone of the plurality of microphones an equal distance from the loudspeaker.

The method comprises an absorbing material positioned inside at least a portion of the pipe.

The absorbing material is positioned between the receptacle and the second end of the pipe.

The absorbing material is wedged at an end nearest the receptacle.

An amount of the absorbing material is an amount that lowers an amount of reflected acoustic energy returning to the plurality of microphones from the second end at least 40 decibels lower than acoustic energy projected from the first end.

The absorbing material comprises bonded absorbent cotton.

The plurality of sections is straight.

At least one section of the plurality of sections is curved.

The components described herein can be components of a single system, multiple systems, and/or geographically separate systems. The components of an embodiment can also be subcomponents or subsystems of a single system, multiple systems, and/or geographically separate systems. The components of an embodiment can be coupled to one or more other components (not shown) of a host system or a system coupled to the host system.

The components of an embodiment include and/or run under and/or in association with a processing system. The processing system includes any collection of processor-based devices or computing devices operating together, or components of processing systems or devices, as is known in the art. For example, the processing system can include one or more of a portable computer, portable communication device operating in a communication network, and/or a network server. The portable computer can be any of a number and/or combination of devices selected from among personal computers, cellular telephones, personal digital assistants, portable computing devices, and portable communication devices, but is not so limited. The processing system can include components within a larger computer system.

The processing system of an embodiment includes at least one processor and at least one memory device or subsystem. The processing system can also include or be coupled to at least one database. The term "processor" as generally used herein refers to any logic processing unit, such as one or more central processing units (CPUs), digital signal processors (DSPs), application-specific integrated circuits (ASIC), etc. The processor and memory can be monolithically integrated onto a single chip, distributed among a number of chips or components of the AMS, and/or provided by some combination of algorithms. The AMS methods described herein can be implemented in one or more of software algorithm(s), programs, firmware, hardware, components, circuitry, in any combination.

The components of an embodiment can be located together or in separate locations. Communication paths couple the components and include any medium for communicating or transferring files among the components. The communication paths include wireless connections, wired connections, and hybrid wireless/wired connections. The communication paths also include couplings or connections to networks including local area networks (LANs), metropolitan area networks (MANs), wide area networks (WANs), proprietary networks, interoffice or backend networks, and the Internet. Furthermore, the communication paths include removable fixed mediums like floppy disks, hard disk drives, and CD-ROM disks, as well as flash RAM, Universal Serial Bus (USB) connections, RS-232 connections, telephone lines, buses, and electronic mail messages.

Aspects of the components of an embodiment described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing the components of an embodiment include: microcontrollers with memory (such as electronically erasable programmable read only memory (EEPROM)), embedded microprocessors, firmware, software, etc. Furthermore, aspects of the components may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word: any of the items in the list, all of the items in the list and any combination of the items in the list.

The above description of embodiments is not intended to be exhaustive or to limit the systems and methods to the precise forms disclosed. While specific embodiments and examples are described herein for illustrative purposes, various equivalent modifications are possible within the scope of the systems and methods, as those skilled in the relevant art will recognize. The teachings of the embodiments provided herein can be applied to other systems and methods, not only for the systems and methods described above.

The elements and acts of the various embodiments described above can be combined to provide further embodiments. These and other changes can be made to the embodiments in light of the above detailed description.

What is claimed is:

1. A device comprising:

a pipe including at least one section that spans between a first end and a second end of the pipe and a hole in the pipe configured to receive a headset mount, wherein the pipe has a cylindrical cross-section;

a receptacle disposed in the headset mount, the receptacle positioned in the pipe a first distance from the first end and a second distance from the second end, wherein the receptacle is configured to receive an electronic device having a plurality of microphones that are to be calibrated, to place the electronic device substantially inside the pipe, and to secure each of the plurality of microphones a third distance inside an inside surface of the pipe;

a firm foam piece substantially disposed at an end of a toggle clamp, the firm foam piece and the toggle clamp being configured to secure the electronic device to the receptacle;

an adapter connected to the first end, wherein the adapter connects a loudspeaker to the pipe, wherein the pipe controls an acoustic energy experienced by the plurality of microphones so that each microphone of the plurality of microphones is configured to receive an input that is substantially equivalent acoustic energy in amplitude and phase to another input received by each microphone of the plurality of microphones.

2. The device of claim 1, wherein the at least one section comprises a single section.

3. The device of claim 1, wherein the at least one section comprises a plurality of sections.

4. The device of claim 3, wherein the plurality of sections comprises five sections.

5. The device of claim 4, wherein a first section comprises the first end, a second section is coupled to the first section and comprises the receptacle, and a fifth section comprises the second end.

6. The device of claim 5, comprising a third section coupled to the second section, wherein the first section and the third section have an equivalent length.

7. The device of claim 6, wherein a length of the first section and the third section is approximately 48 centimeters.

8. The device of claim 6, wherein a length of the second section is approximately 17 centimeters.

9. The device of claim 6, comprising a fourth section coupled to the third section, wherein the fifth section is coupled to the fourth section, wherein the fourth section and the fifth section have an equivalent length.

10. The device of claim 9, wherein a length of the fourth section and the fifth section is approximately 28 centimeters.

11. The device of claim 9, comprising an absorbing material positioned between the receptacle and the second end of the pipe.

12. The device of claim 11, wherein the absorbing material is positioned inside at least a portion of the pipe comprising the third section, the fourth section, and the fifth section.

13. The device of claim 12, wherein the absorbing material in the third section is wedged at an end nearest the receptacle.

14. The device of claim 4, wherein the first distance is approximately 57 centimeters.

15. The device of claim 3, wherein the plurality of sections comprises four sections.

16. The device of claim 15, wherein a first section comprises the first end, and a second section is coupled to the first section and comprises the receptacle.

17. The device of claim 16, wherein a length of the second section is approximately 17 centimeters.

18. The device of claim 16, comprising a third section coupled to the second section.

19. The device of claim 18, wherein a length of the third section is approximately 48 centimeters.

20. The device of claim 18, comprising a fourth section coupled to the third section, wherein the first section and the fourth section have an equivalent length.

21. The device of claim 20, wherein a length of the first section and the fourth section is approximately 28 centimeters.

22. The device of claim 15, wherein the first distance is approximately 37 centimeters.

23. The device of claim 3, wherein the plurality of sections comprises three sections.

24. The device of claim 23, wherein a first section comprises the first end, and a second section is coupled to the first section and comprises the receptacle.

25. The device of claim 24, wherein a length of the second section is approximately 17 centimeters.

26. The device of claim 24, comprising a third section coupled to the second section, wherein the first section and the third section have an equivalent length.

27. The device of claim 26, wherein a length of the first section and the third section is approximately 48 centimeters.

28. The device of claim 27, wherein the first distance is approximately 57 centimeters.

29. The device of claim 26, wherein a length of the first section and the third section is approximately 28 centimeters.

30. The device of claim 29, wherein the first distance is approximately 37 centimeters.

31. The device of claim 24, comprising a third section coupled to the second section, wherein the first section and the third section have different lengths.

32. The device of claim 31, wherein a length of the first section is approximately 48 centimeters.

33. The device of claim 32, wherein a length of the third section is approximately 28 centimeters.

34. The device of claim 33, wherein a length of the second section is approximately 17 centimeters.

35. The device of claim 34, wherein the first distance is approximately 57 centimeters.

36. The device of claim 32, wherein a length of the first section is approximately 28 centimeters.

37. The device of claim 36, wherein a length of the third section is approximately 48 centimeters.

38. The device of claim 37, wherein a length of the second section is approximately 17 centimeters.

39. The device of claim 38, wherein the first distance is approximately 37 centimeters.

40. The device of claim 31, wherein a length of the first section is approximately 15 centimeters.

41. The device of claim 40, wherein a length of the third section is approximately 28 centimeters.

42. The device of claim 41, wherein a length of the second section is approximately 17 centimeters.

43. The device of claim 42, wherein the first distance is approximately 24 centimeters.

44. The device of claim 23, wherein a first section comprises the first end and the receptacle.

45. The device of claim 44, comprising a second section coupled to the first section, and a third section coupled to the second section, wherein the third section comprises the second end.

46. The device of claim 45, wherein a length of the first section is approximately 17 centimeters.

47. The device of claim 46, wherein a length of the second section is approximately 48 centimeters.

48. The device of claim 47, wherein a length of the third section is approximately 28 centimeters.

49. The device of claim 48, wherein the first distance is approximately 8 centimeters.

50. The device of claim 3, wherein the plurality of sections comprises two sections.

51. The device of claim 50, wherein a first section comprises the first end and the receptacle.

52. The device of claim 51, comprising a second section coupled to the first section, wherein the second section comprises the second end.

53. The device of claim 52, wherein a length of the first section is approximately 17 centimeters.

54. The device of claim 53, wherein a length of the second section is approximately 48 centimeters.

55. The device of claim 54, wherein the first distance is approximately 8 centimeters.

56. The device of claim 53, wherein a length of the second section is approximately 28 centimeters.

57. The device of claim 56, wherein the first distance is approximately 8 centimeters.

58. The device of claim 1, wherein the first distance is at least 30 centimeters.

59. The device of claim 1, wherein the second end is open.

60. The device of claim 1, wherein the second end is coupled to a cap, wherein the cap closes the second end.

61. The device of claim 60, wherein the cap is tapered.

62. The device of claim 61, wherein an inside diameter of the cap changes linearly as a function of a length of the cap.

63. The device of claim 62, wherein the length of the cap is in a approximately in a range of 2 inches to 34 inches.

64. The device of claim 1, wherein an inside diameter of the pipe is approximately in a range of 2 inches to 4 inches.

65. The device of claim 1, wherein the third distance is approximately in a range of 2 to 5 millimeters.

66. The device of claim 1, wherein the headset mount locates each microphone of the plurality of microphones an equal distance from the loudspeaker.

67. The device of claim 1, comprising an absorbing material positioned inside at least a portion of the pipe.

68. The device of claim 67, wherein the absorbing material is positioned between the receptacle and the second end of the pipe.

69. The device of claim 68, wherein the absorbing material is wedged at an end nearest the receptacle.

70. The device of claim 67, wherein an amount of the absorbing material is an amount that lowers an amount of reflected acoustic energy returning to the plurality of microphones from the second end of at least 40 decibels lower than acoustic energy projected from the first end.

71. The device of claim 67, wherein the absorbing material comprises bonded absorbent cotton.

72. The device of claim 1, wherein the loudspeaker is a mouth simulator loudspeaker.

73. The device of claim 1, wherein the at least one section is straight.

74. The device of claim 1, wherein the at least one section is curved.

75. The device of claim 1, wherein the equivalent acoustic energy comprises equivalent amplitude and phase.

* * * * *